US010841700B2

(12) United States Patent
Igarashi et al.

(10) Patent No.: US 10,841,700 B2
(45) Date of Patent: Nov. 17, 2020

(54) SOUND PICKUP DEVICE

(71) Applicant: Sony Corporation, Tokyo (JP)

(72) Inventors: Go Igarashi, Tokyo (JP); Toru Nakagawa, Chiba (JP); Naoki Shinmen, Tokyo (JP); Tetsu Magariyachi, Kanagawa (JP); Homare Kon, Tokyo (JP); Koyuru Okimoto, Tokyo (JP); Kohei Asada, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 16/472,419

(22) PCT Filed: Nov. 1, 2017

(86) PCT No.: PCT/JP2017/039490
§ 371 (c)(1),
(2) Date: Jun. 21, 2019

(87) PCT Pub. No.: WO2018/123252
PCT Pub. Date: Jul. 5, 2018

(65) Prior Publication Data

US 2019/0349681 A1 Nov. 14, 2019

(30) Foreign Application Priority Data

Dec. 29, 2016 (JP) ..... 2016-257266

(51) Int. Cl.
*H04R 1/10* (2006.01)
*H04R 5/027* (2006.01)

(52) U.S. Cl.
CPC ..... *H04R 5/027* (2013.01); *H04R 1/1016* (2013.01)

(58) Field of Classification Search
CPC ... H04R 1/00; H04R 1/02; H04R 1/08; H04R 1/10; H04R 1/105; H04R 1/1016;
(Continued)

(56) References Cited

U.S. PATENT DOCUMENTS

2005/0018838 A1 1/2005 Meunier et al.
2008/0310662 A1* 12/2008 Davidson ..... H04R 1/1083 381/355

(Continued)

FOREIGN PATENT DOCUMENTS

CA 2 964 710 A1 5/2016
JP 62-274900 A 11/1987

(Continued)

OTHER PUBLICATIONS

International Written Opinion and English translation thereof dated Jan. 9, 2018 in connection with International Application No. PCT/JP2017/039490.

(Continued)

*Primary Examiner* — Thang V Tran
(74) *Attorney, Agent, or Firm* — Wolf, Greenfield & Sacks, P.C.

(57) ABSTRACT

To provide a sound pickup device which is worn on an ear of a user and used.
A sound pickup device includes: a sound pickup part; and a holding part that includes a sound transmission part and is configured to hold the sound pickup part in an ear canal of a user. The holding part includes a ring body having an opening portion that serves as the sound transmission part, and one or more arms each of which has one end coupled to the ring body and another end supporting the sound pickup part. The ring body is inserted into a cavum concha of the user and is locked in a vicinity of an intertragic notch. The holding part holds the sound pickup part so that a micro-
(Continued)

phone hole is oriented to outside of the ear canal and the microphone hole is positioned on a farther side of an entrance of the ear canal.

13 Claims, 30 Drawing Sheets

(58) Field of Classification Search
CPC .. H04R 1/1058; H04R 1/1066; H04R 1/1075; H04R 1/124; H04R 5/027; H04R 5/033; H04R 5/0335; H04R 25/00; H04R 25/02; H04R 25/60; H04R 2460/09; H04R 2460/11
See application file for complete search history.

(56) References Cited

U.S. PATENT DOCUMENTS

| | | | | |
|---|---|---|---|---|
| 2009/0290739 | A1* | 11/2009 | Edwards | H04R 25/305 381/328 |
| 2010/0195860 | A1* | 8/2010 | Becker | H04R 1/1016 381/371 |
| 2010/0278350 | A1* | 11/2010 | Rung | G01H 3/14 381/59 |
| 2011/0098787 | A1 | 4/2011 | Spearman et al. | |
| 2013/0089225 | A1 | 4/2013 | Tsai | |
| 2013/0343594 | A1* | 12/2013 | Howes | H04R 1/1016 381/380 |
| 2014/0294191 | A1 | 10/2014 | Parkins | |
| 2015/0365765 | A1 | 12/2015 | Gwon | |
| 2017/0289711 | A1* | 10/2017 | Maas | H04R 25/402 |

FOREIGN PATENT DOCUMENTS

| | | | | |
|---|---|---|---|---|
| JP | 403117999 | A * | 5/1991 | H04R 1/10 |
| JP | 04-095008 | U | 8/1992 | |
| JP | 2004-128854 | A | 4/2004 | |
| JP | 2007-142601 | A | 6/2007 | |
| JP | 2008-512015 | A | 4/2008 | |
| JP | 3155238 | U | 10/2009 | |

OTHER PUBLICATIONS

International Preliminary Report on Patentability and English translation thereof dated Jul. 11, 2019 in connection with International Application No. PCT/JP2017/039490.
International Search Report and English translation thereof dated Jan. 9, 2018 in connection with International Application No. PCT/JP2017/039490.
Partial European Search Report dated Nov. 8, 2019 in connection with European Application No. 17888979.6.
Extended European Search Report dated Feb. 13, 2020 in connection with European Application No. 17888979.6.

* cited by examiner

1100

SOUND PICKUP DEVICE

CROSS-REFERENCE TO RELATED APPLICATIONS

This application claims the benefit under 35 U.S.C. § 371 as a U.S. National Stage Entry of International Application No. PCT/JP2017/039490, filed in the Japanese Patent Office as a Receiving Office on Nov. 1, 2017, which claims priority to Japanese Patent Application Number JP2016-257266, filed in the Japanese Patent Office on Dec. 29, 2016, each of which is hereby incorporated by reference in its entirety.

TECHNICAL FIELD

The technology disclosed in the present specification relates to a sound pickup device which is worn on an ear of a user and used.

BACKGROUND ART

Recent years have seen the widespread use of in-ear type sound pickup devices which are worn on an ear of a user and used. Such an in-ear type sound pickup device has, for example, a binaural recording technique. The binaural recording is to record a sound having a state close to a sound which reaches an eardrum of each user, in light of differences according to each individual such as the shape of head, body, or earlobe of each user (well-known technique). In a case where binaural-recorded sounds are heard using earphones or headphones, a realistic sensation of actually being at the site for recording can be reproduced. In addition, on the basis of binaural-recorded audio signals, a head-related transfer function (HRTF) can be calculated which represents a change in sound caused according to the influence of diffraction or reflection on each part of a human body such as a head, body or earlobe of each user. For example, the HRTF is convoluted with audio signals reproduced from a typical sound source (dry source), which enables virtual sound localization and reproduces a realistic sensation.

In addition, another application of such an in-ear type sound pickup device includes noise cancelling together with a wearable sound output device such as earphones or headphones.

Technologies have been already proposed for performing binaural recording using an in-ear type device (refer to Patent Literatures 1 and 2, for example). According to most of the devices proposed, a sound pickup part such as a microphone is placed outside an ear canal of a user, and the device body has an enclosed structure to close an ear cavity of a user substantially completely.

CITATION LIST

Patent Literature

Patent Literature 1: JP 2004-128854A
Patent Literature 2: JP 2008-512015T

DISCLOSURE OF INVENTION

Technical Problem

An object of the technology disclosed in the present specification is to provide an excellent sound pickup device which is worn on an ear of a user and used.

Solution to Problem

A technology disclosed in the present description, which is made in view of the aforementioned problem, is a sound pickup device including: a sound pickup part; and a holding part that includes a sound transmission part and is configured to hold the sound pickup part in an ear canal of a user.

The holding part includes a ring body having an opening portion that serves as the sound transmission part, and one or more arms each of which has one end coupled to the ring body and another end supporting the sound pickup part. The ring body is inserted into a cavum concha of the user and is locked in a vicinity of an intertragic notch.

Alternatively, the holding part includes an elastic member, e.g., a sponge, having a vent portion that serves as the sound transmission part.

Alternatively, the holding part includes a star-like member having an opening portion that serves as the sound transmission part, and one or more arms each of which has one end coupled to the star-like member and another end supporting the sound pickup part.

The holding part in any configuration basically holds the sound pickup part so that a microphone hole is oriented to outside of the ear canal. The holding part holds the sound pickup part so that a microphone hole is positioned on a farther side of an entrance of the ear canal.

Moreover, the sound pickup device may further include a sound output part.

In a case where the sound pickup device fits in an ear of the user, a relative position between a sound output hole of the sound output part and a sound pickup hole of the sound pickup part is configured to be kept constant. Moreover, in a case where the sound pickup device fits in an ear of the user, a sound output hole of the sound output part is configured to be positioned outside an ear cavity as compared with a sound pickup hole of the sound pickup part.

Advantageous Effects of Invention

According to the technology disclosed in the present specification, an excellent sound pickup device which is worn on an ear of a user and used can be provided.

Note that the effects described in the present specification are merely examples, and effects of the present invention are not limited to these. Further, there is also a case where the present invention further provides additional effects other than the above-described effects.

Other objects, features and advantages of the technology disclosed in the present specification will become more clear from the detailed description based on an embodiment which will be described later and the accompanying drawings.

MODE(S) FOR CARRYING OUT THE INVENTION

An embodiment of the technology disclosed in the present specification will be described below with reference to the drawings.

Example 1

FIG. 1 to FIG. 4 show states of an in-ear type sound pickup device 100 according to an embodiment of the technology disclosed in the present specification as viewed from various angles.

Figure 1:
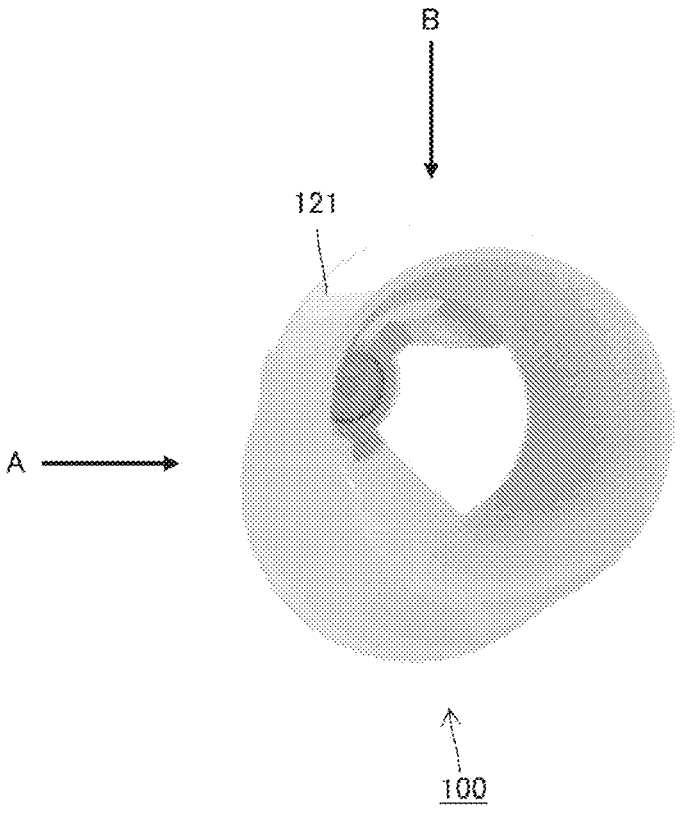
FIG. 1 is a diagram illustrating the external configuration of an in-ear type sound pickup device 100.
Figure 2:
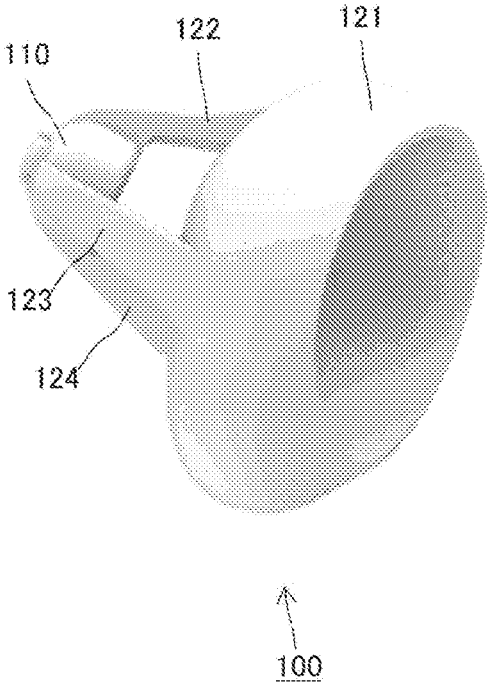
FIG. 2 is a diagram illustrating the external configuration of the in-ear type sound pickup device 100.
Figure 3:
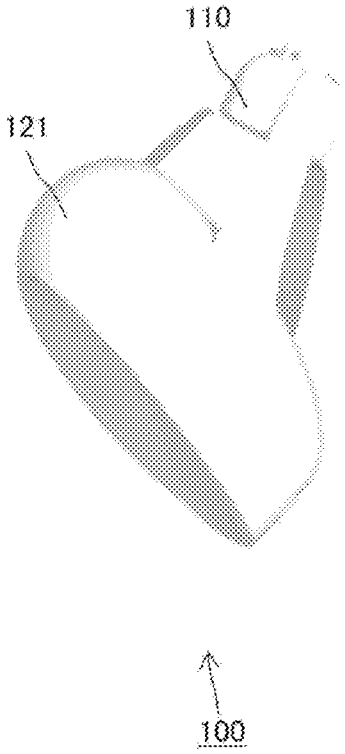
FIG. 3 is a diagram illustrating the external configuration of the in-ear type sound pickup device 100.

FIG. 1 is a front view of the sound pickup device 100 viewed from the front direction (or the direction in which the sound pickup device 100 in an attitude of fitting in an ear cavity of a user is viewed from the outside of the ear). FIG. 2 is a side view of the sound pickup device 100 as viewed from the direction indicated by an arrow A in FIG. 1, and FIG. 3 is a side view of the sound pickup device 100 as viewed from the direction indicated by an arrow B in FIG. 1.

As shown in each of the drawings, the sound pickup device 100 includes a sound pickup part 110 having a microphone and the like and a holding part for holding the sound pickup part 110 in an ear canal. The holding part includes a hollow ring body 121 (in other words, ring body 121 having an opening portion through which to transmit a sound) and a plurality of arms (three arms in the illustrated examples) 122-124 for supporting the sound pickup part 110. Each of the arms 122-124 has one end coupled to the ring body 121 and the other end supporting the sound pickup part 110. It is assumed that the sound pickup part 110 has, for example, a cylindrical shape with a diameter of approximately 2.5 millimeters. Note that the ring body 121 and the arms 122-124 may be components formed by integrally molding the same material such as resin, or may be components formed by double molding of different materials.

The holding part holds, in the ear canal, the sound pickup part 110. Here, it means that the sound pickup part 110 is held in such a manner that a microphone hole 111 serving as a sound pickup hole is placed on a farther side (eardrum side) of the entrance of the ear canal. The ear canal has a cylindrical shape forming an S-shaped curve, and the holding part holds the sound pickup part 110 at a far position, for example, not more than 15 millimeters to the depth of the ear canal from the entrance thereof. It is preferable that the holding part hold the sound pickup part 110 at such a position that a node of the standing wave generated in the cylindrical ear canal is skipped.

Figure 4:
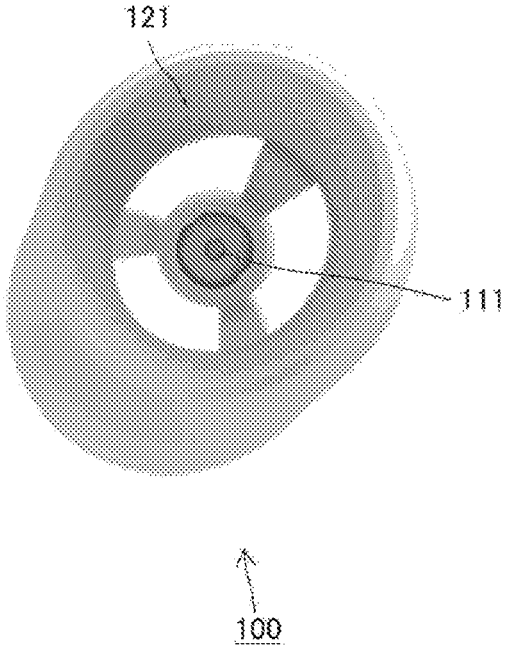
FIG. 4 is a diagram illustrating the external configuration of the in-ear type sound pickup device 100.
Figure 32:
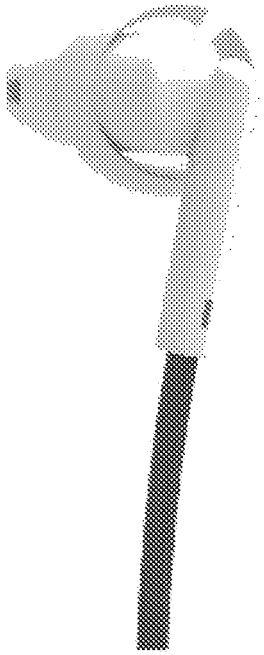
FIG. 32 is a diagram illustrating the external configuration of a sound pickup device having a C-shaped holding part.
Figure 33:
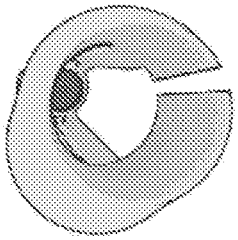
FIG. 33 is a diagram illustrating the external configuration of a sound pickup device having a C-shaped holding part.

The ring body 121 is, for example, approximately 13.5 millimeters in dimension and can fit in a cavum concha of the user. In the example shown in FIG. 1 or the like, the ring body 121 has a shape such as a closed O-ring with no cut portion (hereinafter also referred to as an "O-shape" simply) regardless of whether or not there is a straight line portion and a curve portion. However, as shown in FIG. 32 and FIG. 33, the ring body may have an open C-shape with a cut portion (hereinafter also referred to as a "C-shape" simply) regardless of whether or not there is a straight line portion and a curve portion and may have a shape so as to be engaged with the cavum concha. Although the size of the cavum concha varies from person to person, if the outer diameter (or width) of the ring body 121 is set to be larger than 16 millimeters, then many people are not be able to insert the ring body 121 into the cavum concha. In a state where the ring body 121 fits in the cavum concha, it is preferable that the sound pickup part 110 be supported by the arms 122 to 124 such that the sound pickup part 110 floats completely in the air without contacting an inner wall of the ear canal, or, alternatively, such that the contact between the sound pickup part 110 and the inner wall of the ear canal is minimized. In addition, the sound pickup part 110 is supported by the arms 122 to 124 such that the sound pickup direction (or the microphone hole 111) is oriented to face the entrance direction of the ear canal (i.e., the external environment), not to face the depth of the ear canal (i.e., the eardrum side) or the inner wall side of the ear canal. Thus, the sound pickup part 110 can suitably pick up an ambient sound that has been transmitted into the ear canal. FIG. 4 is a front view of the sound pickup device 100 in an attitude where the sound pickup part 110 is seen around the center of the hollow ring body 121.

Figure 5:
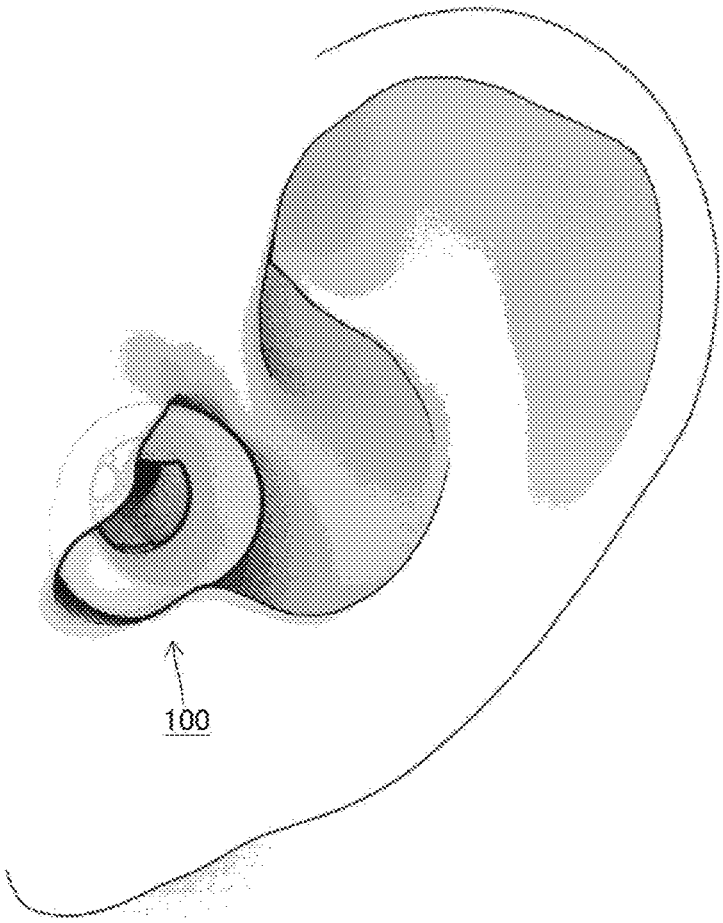
FIG. 5 is a diagram illustrating an auricle (left ear) having an ear cavity in which the sound pickup device 100 fits.

FIG. 5 illustrates an auricle (the left ear) in which the sound pickup device 100 fits. The ring body 121 is preferably inserted into the cavum concha, is in contact with the bottom surface of the cavum concha, and is locked to the auricle so that the ring body 121 is hooked on a V-shaped intertragic notch. Thereby, the sound pickup device 100 suitably fits in the auricle.

The ring body 121 has a hollow structure, and almost all of the inner side thereof is the opening portion. Thus, even in a state where the ring body 121 is inserted into the cavum concha, the ear cavity of the user is not closed. It can be therefore said that the ear cavity of the user is open, the sound pickup device 100 is of an ear cavity open type, and has a sound transmission performance.

Figure 6:
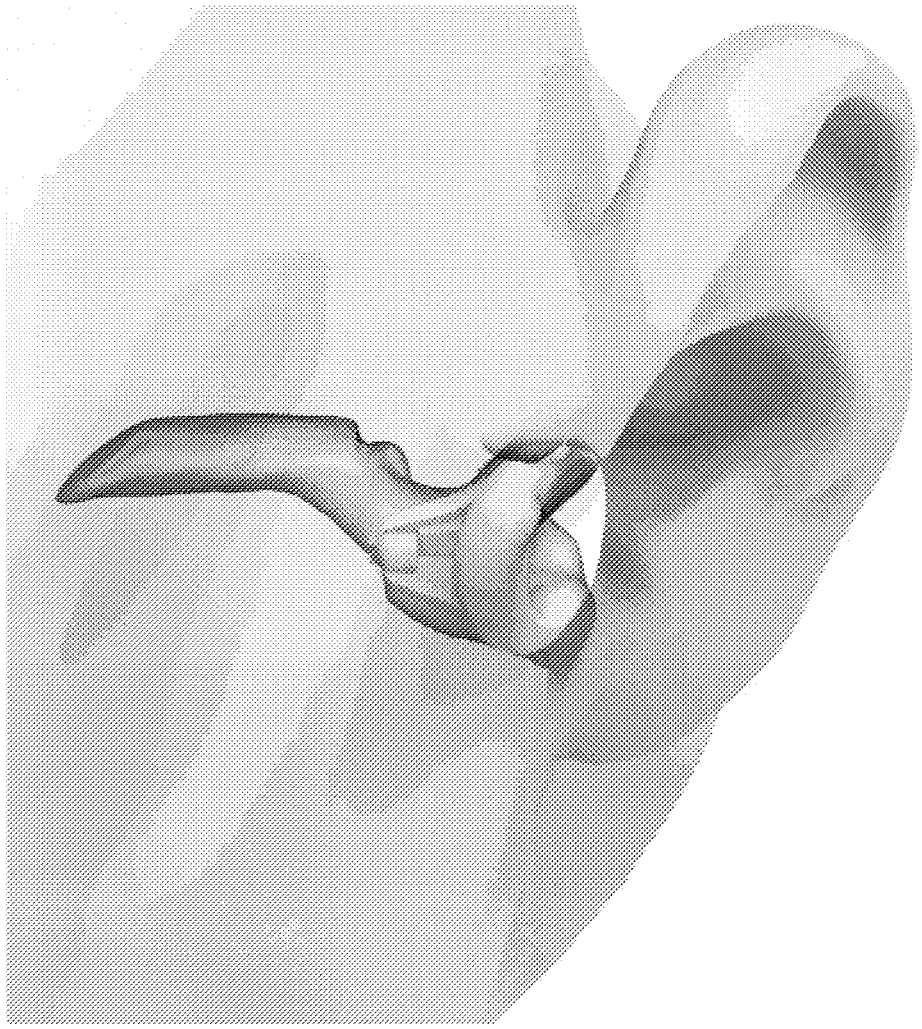
FIG. 6 is a cross-sectional view illustrating a head of a user wearing the sound pickup device 100 on an ear cavity of the left ear.

FIG. 6 shows a longitudinal sectional view, of a head of the user wearing the sound pickup device 100 in the ear cavity of the left ear, cut with a coronal plane that passes through the ear canal. As shown in FIG. 6, the sound pickup part 110 is supported by the arms 122 to 124 so as to protrude from the ring body 121 toward the depth (eardrum side) of the ear canal. It should be understood that the sound pickup part 110 is so held that the microphone hole 111 is placed on a farther side (eardrum side) of the entrance of the ear canal. It should also be understood that the sound pickup part 110 is supported by the arms 122 to 124 such that the sound pickup part 110 floats completely in the air without contacting the inner wall of the ear canal, or, alternatively, such that the contact between the sound pickup part 110 and the inner wall of the ear canal is minimized. The ring body 121 has appropriate dimensions and suitable elasticity, which increases the fit in the user.

Although only one of the left and right sound pickup devices 100 is shown in FIG. 1 to FIG. 6, it should be understood that a set of the left and right sound pickup devices 100 are worn on the left and right ears of the user and binaural recording is performed. In each of FIG. 1 to FIG. 6, the illustration of a signal line (cable) for inputting audio signals and supplying power is omitted for the sake of convenience.

As can be seen from FIG. 6, according to the sound pickup device 100 of this embodiment, the sound pickup part 110 is configured to be supported inside the ear canal in the fitting state in the vicinity of the entrance of the ear canal (cavum concha) of the user. In addition, the sound pickup part 110 is configured to be supported by the plurality of arms 122 to 124 coupled to the hollow ring body 121, namely, ring body 121 having the opening portion in such a manner that the sound pickup direction (or the microphone hole 111) is oriented to face outside the ear canal. In other words, it can be said that the holding part of the sound pickup part 110 including the ring body 121 and the arms 122 to 124 is of an ear cavity open type and of a sound transmission type.

Accordingly, an ambient sound that is to be picked up by the user can transmit through the ear cavity open type holding part to reach the sound pickup part 110, and can be picked up suitably. In addition, since the sound pickup part 110 is supported at a location closer to the eardrum inside the ear canal not outside the ear canal, the ambient sound can be picked up in a state close to that of a sound heard by the user.

In addition, a change in ambient sound may be caused not only by the influence of commentary or reflection on the surface of a human body such as the head, body or earlobe of the user but also by the influence of diffraction or reflection on the inner wall of the ear canal, and further by the influence of reflection on the eardrum. According to the sound pickup device 100 of this embodiment, since the sound pickup part 110 is placed inside the ear canal, it is possible to implement binaural recording in light of the influence of diffraction or reflection on the inner wall of the ear canal and reflection on the eardrum, so that it is possible to reproduce a realistic sensation with high accuracy. Further, according to the sound pickup device 100 of this embodiment, it is possible to determine a head-related transfer function with high accuracy representing a change in sound, in light of not only the parts of the human body such as the head, body, or earlobe of each user but also the shape of the ear canal and the influence of a reflected sound from the eardrum.

Figure 7:
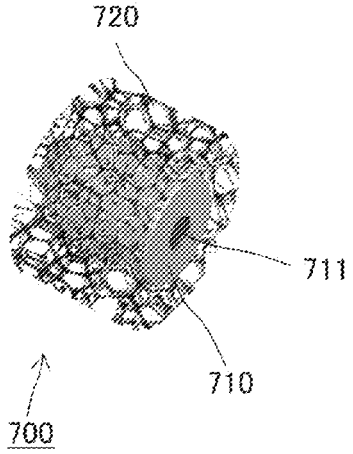
FIG. 7 is a diagram illustrating the external configuration of an in-ear type sound pickup device 700.
Figure 8:
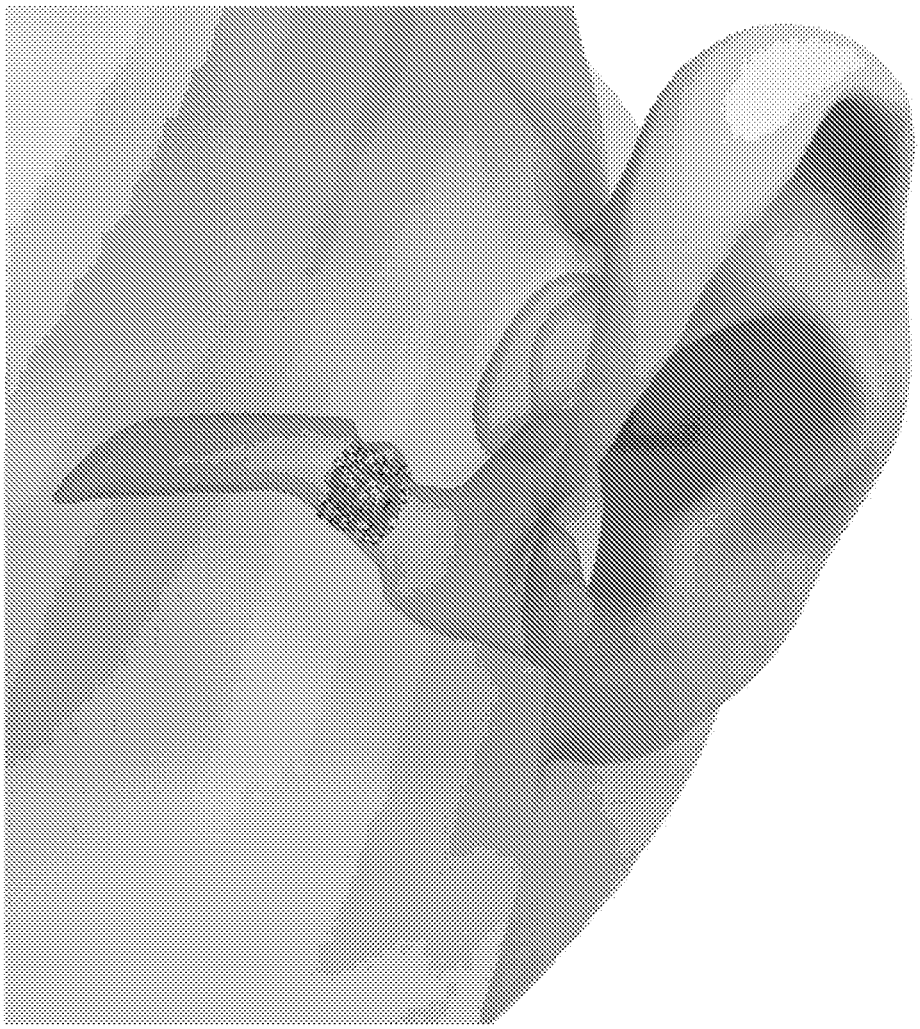
FIG. 8 is a cross-sectional view illustrating a head of a user wearing the sound pickup device 700.

FIG. 7 shows an example of the external configuration of another sound pickup device 700 which is of an ear cavity open type and is capable of supporting a sound pickup part inside the ear canal. FIG. 8 shows a longitudinal sectional view, of the head of the user wearing the sound pickup device 700 in the ear cavity of the left ear, cut with a coronal plane that passes through the ear canal. In each of FIG. 7 and FIG. 8, the illustration of a signal line (cable) for inputting audio signals and supplying power is omitted for the sake of convenience. Although only one of the left and right sound pickup devices 700 is shown in FIG. 7 and FIG. 8, it should be understood that a set of the left and right sound pickup devices 700 are worn on the left and right ears of the user and binaural recording is performed.

The sound pickup device 100 shown in FIG. 1 or the like uses the holding part including the arms 122-124 and the ring body 121 having the opening portion to support the sound pickup part 110 in a state where the sound pickup part 110 floats completely in the air without contacting the inner wall of the ear canal (or, alternatively, such that the contact between the sound pickup part 110 and the inner wall of the ear canal is minimized). The sound pickup device 100 is of an ear cavity open type and ensures the sound transmission performance. In contrast, the sound pickup device 700 shown in FIG. 7 includes a sound pickup part 710 and a holding part 720 having a vent portion such as a sponge. The holding part 720 covers the exterior of the sound pickup part 710 and is shaped like a cylinder having an outer diameter. In addition, it is assumed that the sound pickup part 110 has a cylindrical shape having a diameter of, for example, approximately 2.5 millimeters (same as above).

In the fitting state shown in FIG. 8, the sound pickup device 700 is locked in the vicinity of a first curve of the ear canal; however, the sound pickup part 710 is supported in a state where the sound pickup part 710 floats completely in the air without contacting the inner wall of the ear canal (or, alternatively, such that the contact between the sound pickup part 710 and the inner wall of the ear canal is minimized). It can be understood from FIG. 8 that the sound pickup device 700 is of an ear cavity open type and ensures the sound transmission performance as with the sound pickup device 100 shown in FIG. 1. It should also be understood that the sound pickup part 710 is held in such a manner that a microphone hole 711 serving as a sound pickup hole is placed on a farther side (eardrum side) of the entrance of the ear canal. The ear canal has a cylindrical shape forming an S-shaped curve, and the holding part 720 holds the sound pickup part 710 at a far position, for example, not more than 15 millimeters to the depth of the ear canal from the entrance thereof.

Since the sound pickup part 710 is supported at a location closer to the eardrum inside the ear canal not outside the ear canal, the ambient sound can be picked up in a state close to that of a sound heard by the user. Since the sound pickup part 710 is placed inside the ear canal, it is possible to implement binaural recording in light of the influence of diffraction or reflection on the inner wall of the ear canal and reflection on the eardrum, so that it is possible to reproduce a realistic sensation with high accuracy. Thus, according to the sound pickup device 700, it is possible to determine a head-related transfer function with high accuracy representing a change in sound, in light of not only the parts of the human body such as the head, body, or earlobe of each user but also the shape of the ear canal and the influence of the reflected sound from the eardrum.

In the fitting state of the sound pickup device 700, it is preferable that the sound pickup direction (or the microphone hole 711) of the sound pickup part 710 be oriented to the outside of the ear canal. It can also be said that it is preferable that the sound pickup direction of the sound pickup part 710 be oriented to the outside of the ear canal rather than the depth of the ear canal (i.e., the eardrum side) or the inner wall side of the ear canal. In addition, the holding part 720 having the vent portion has appropriate dimensions and suitable elasticity, which increases the fit in the user.

Figure 9:
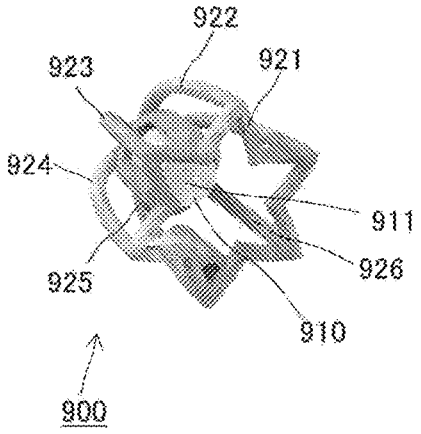
FIG. 9 is a diagram illustrating the external configuration of an in-ear type sound pickup device 900.
Figure 10:
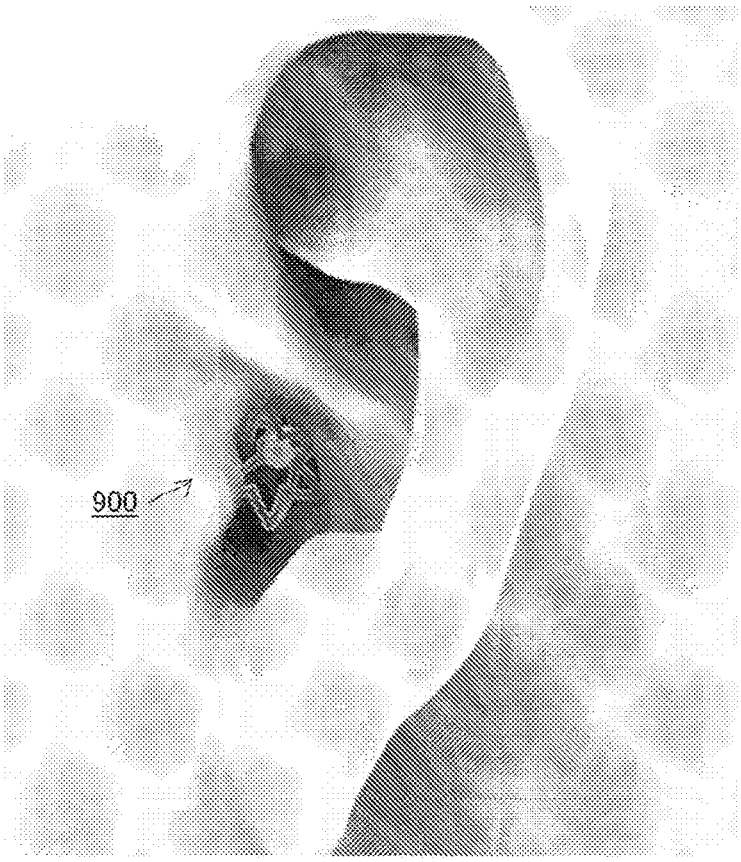
FIG. 10 is a diagram illustrating a state in which the sound pickup device 900 fits in an ear cavity of a user.

FIG. 9 shows an example of the external configuration of yet another sound pickup device 900 which is of an ear cavity open type and is capable of supporting a sound pickup part inside the ear canal. In addition, FIG. 10 shows a state in which the sound pickup device 900 fits in the ear cavity of the user. In each of FIG. 9 and FIG. 10, the illustration of a signal line (cable) for inputting audio signals and supplying power is omitted for the sake of convenience. Although only one of the left and right sound pickup devices 900 is shown in FIG. 9 and FIG. 10, it should be understood that a set of the left and right sound pickup devices 900 are worn on the left and right ears of the user and binaural recording is performed.

The sound pickup device 900 shown in FIG. 9 includes a sound pickup part 910 and a holding part having a frame structure and an opening portion. The holding part includes a hollow star-like member 921 (in other words, star-like member 921 having an opening portion through which to transmit a sound), and a plurality of arms (five arms in the illustrated example) 922-926 for supporting the sound pickup part 910. Each of the arms 922-926 has one end coupled to an apex of the star-like member 921 and the other end supporting the sound pickup part 910. In addition, it is assumed that the sound pickup part 910 has a cylindrical shape having a diameter of, for example, approximately 2.5 millimeters (same as above).

The star-like member 921 has a dimension equivalent to an inner diameter of the ear canal near the entrance thereof, and the sound pickup device 900 can fit in the entrance of the ear canal as shown in FIG. 10. In a state where the star-like member 921 fits in the entrance of the ear canal, the sound pickup part 910 is supported by the arms 922 to 926 such that the sound pickup part 910 floats completely in the air without contacting the inner wall of the ear canal, or, alternatively, such that the contact between the sound pickup part 910 and the inner wall of the ear canal is minimized. It should be therefore understood that the sound pickup device 900 is of an ear cavity open type and ensures the sound transmission performance. It should also be understood that the sound pickup part 910 is held in such a manner that a microphone hole 911 serving as a sound pickup hole is placed on a farther side (eardrum side) of the entrance of the ear canal. The ear canal has a cylindrical shape forming an S-shaped curve, and the holding part holds the sound pickup part 910 at a far position, for example, not more than 15 millimeters to the depth of the ear canal from the entrance thereof.

In a case where the sound pickup device 900 is inserted into the ear cavity of the user as shown in FIG. 10, the arms 922 to 926 of the holding part of the frame structure are squashed in the inner wall of the ear canal and the shape of the arms 922 to 926 is altered to an elongated shape. At this time, the shape of the star-like member 921 changes so as to be closed. The holding part having the frame structure has appropriate dimensions and suitable elasticity, which increases the fit in the user. Note that the star-like member 921 and the arms 922 to 926 may be components formed by integrally molding the same material such as resin, or may be components formed by double molding of different materials.

Note that the shape of the frame structure of the holding part may be any shape, and the shape may be designed from the viewpoint of functionality or may be designed to have a shape on which appearance is emphasized from the viewpoint of design. The star-like member 921 may have a shape of hexagonal star instead of the pentagonal star, or, alternatively, does not necessarily have a star-like shape.

Since the sound pickup part 910 is supported at a location closer to the eardrum inside the ear canal not outside the ear canal, the ambient sound can be picked up in a state close to that of a sound heard by the user. Since the sound pickup part 910 is placed inside the ear canal, it is possible to implement binaural recording in light of the influence of diffraction or reflection on the inner wall of the ear canal and reflection on the eardrum, so that it is possible to reproduce a realistic sensation with high accuracy. Thus, according to the sound pickup device 900, it is possible to determine a head-related transfer function with high accuracy representing a change in sound, in light of not only the parts of the human body such as the head, body, or earlobe of each user but also the shape of the ear canal and the influence of the reflected sound from the eardrum.

The sound pickup part 910 is supported by the arms 922 to 924 such that the sound pickup direction (or the microphone hole 911) is oriented to the external environment, not to face the depth of the ear canal (i.e., the eardrum side). Thus, the sound pickup part 910 can suitably pick up an ambient sound that has been transmitted into the ear canal. It can be said that it is preferable that the sound pickup direction of the sound pickup part 910 be oriented to the outside of the ear canal rather than the depth of the ear canal (i.e., the eardrum side) or the inner wall side of the ear canal.

Example 2

Figure 11:
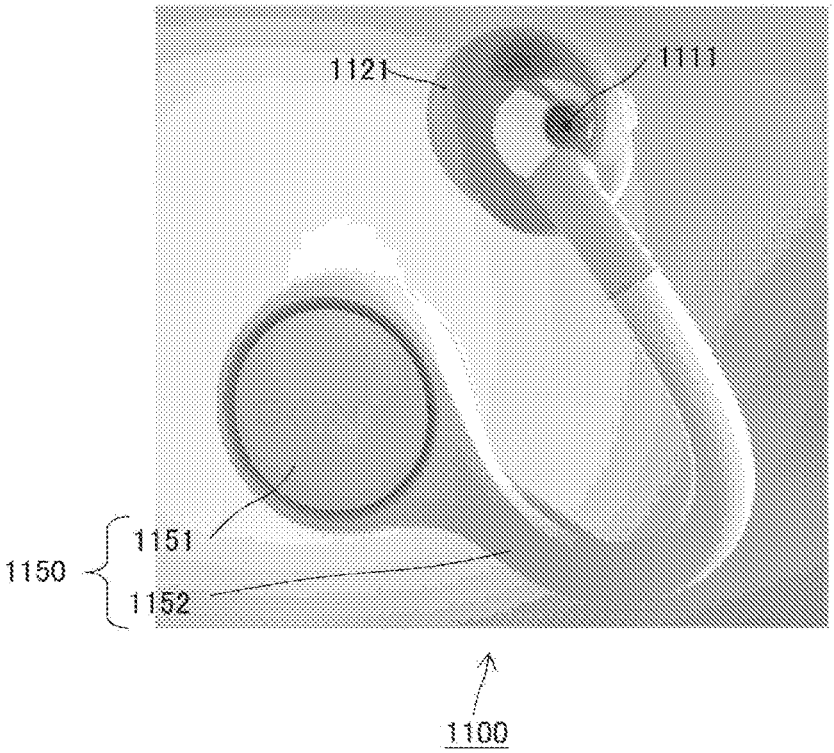
FIG. 11 is a front view of a sound pickup device 100 with a sound output function (for fitting in the right ear).
Figure 12:
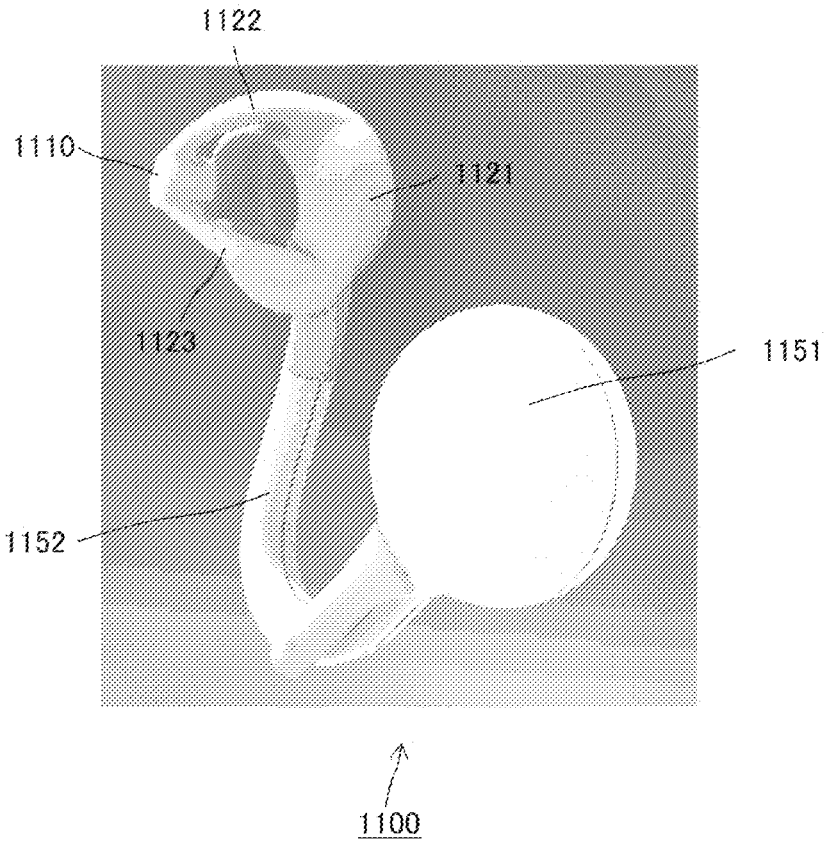
FIG. 12 is a perspective view of the sound pickup device 100 with a sound output function (for fitting in the right ear).
Figure 13:
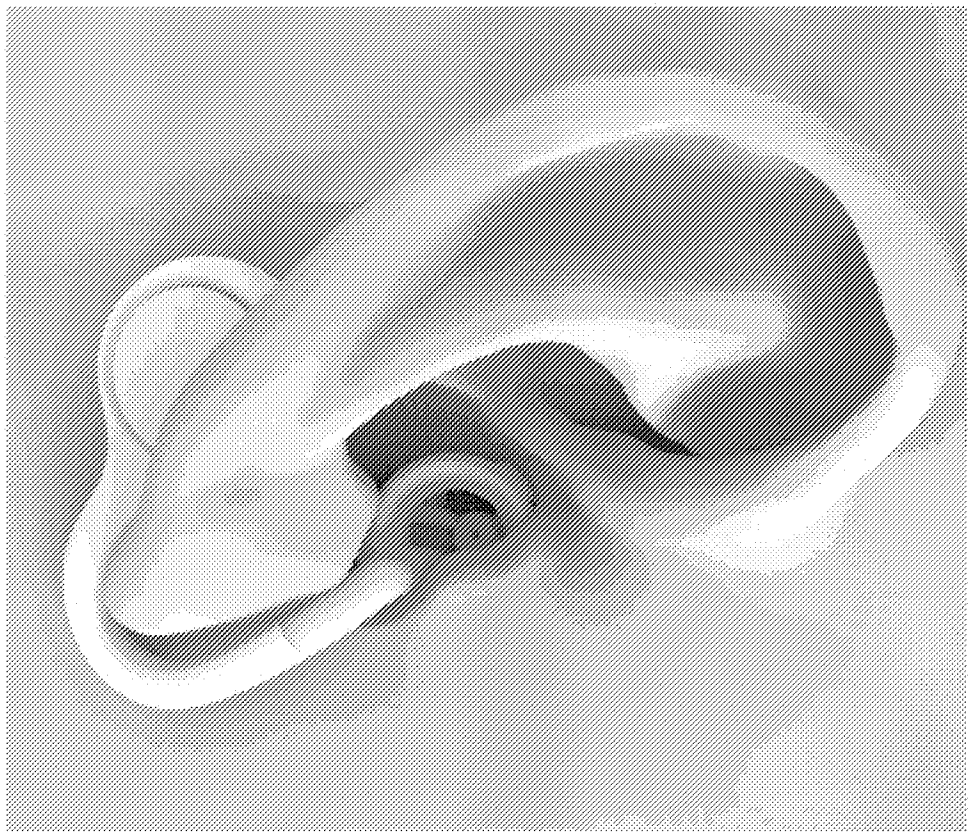
FIG. 13 is a diagram illustrating a state in which the sound pickup device 100 with a sound output function fits in the right ear of a user.

FIG. 11 to FIG. 13 show configuration examples of a sound pickup device 1100 with a sound output part according to another embodiment of the technology disclosed in the present specification. FIG. 11 is a front view of the sound pickup device 1100 with a sound output function (for fitting in the right ear). FIG. 12 is a perspective view of the sound pickup device 1100 with a sound output function (for fitting in the right ear). FIG. 13 shows a state in which the sound pickup device 1100 with a sound output function fits in the right ear of the user. Although only one of the left and right sound pickup devices 1100 is shown in FIG. 11 to FIG. 13, it should be understood that a set of the left and right sound pickup devices 1100 are worn on the left and right ears of the user and binaural recording or binaural reproduction can be implemented.

The sound pickup device 1100 includes a sound pickup part 1110, a holding part for holding the sound pickup part 1110, and a sound output part 1150. In the illustrated sound pickup device 1100, the sound pickup part 1110 and the holding part have substantially the same configuration as that of the sound pickup device 100 shown in FIG. 1. To be specific, the sound pickup part 1110 is a microphone having a cylindrical shape with a diameter of, for example, approximately 2.5 millimeters. The holding part includes a hollow ring body 1121 (in other words, ring body 1121 having an opening portion through which to transmit a sound) and a plurality of arms 1122 . . . for supporting the sound pickup part 1110. In the illustrated example, the ring body 1121 has an O-shape; however the ring body 1121 may have a C-shape. Each of the arms is coupled to the ring body 1121 at one end thereof and supports the sound pickup part 1110 at the other end thereof in such an attitude that the sound pickup direction (or a microphone hole 1111 serving as a sound pickup hole) is oriented to the outside of the ear canal. It can also be said that it is preferable that the sound pickup direction of the sound pickup part 1110 be oriented to the outside of the ear canal rather than the depth of the ear canal (i.e., the eardrum side) or the inner wall side of the ear canal.

The following is the same as described above with reference to FIG. 1 or the like: the sound pickup part 1110 is of an ear cavity open type and has a sound transmission performance; the sound pickup part 1110 is supported at a location closer to the eardrum inside the ear canal and the ambient sound can be picked up in a state close to that of a sound heard by the user; and it is possible to perform binaural recording and determine a head-related transfer function in light of not only the parts of the human body such as the head, body, or earlobe of each user but also the shape of the ear canal and the influence of the reflected sound from the eardrum.

In order to ensure the feature that the sound pickup part 1110 is of an ear cavity open type and has a sound transmission performance, the sound output part 1150 to be combined with the sound pickup part 1110 also has the feature of sound transmission performance. An ear cavity open type sound output device is described in, for example, Japanese Patent Application No. 2016-039004, which has already been assigned to the present Applicant, and the sound output part 1150 according to the present example has a configuration similar thereto.

The sound output part 1150 includes a sound generation part 1151 for generating a sound and a sound guide part 1152 that captures, from one end thereof, the sound generated by the sound output part 1150 and outputs, from the other end, the sound toward the entrance of the ear canal. The sound guide part 1152 joins with the ring body 1121 of the above-described holding part in the vicinity of the other end which is an open end.

The sound generation part 1151 uses a sound generation element with a diameter of approximately 16 millimeters for causing a sound pressure change such as a dynamic type driver (alternatively, an electrostatic type driver or a piezoelectric type driver); therefore, an air pressure change is caused in the housing of the sound generation part 1151 when the sound is generated. With this being the situation, one or more exhaust holes (not shown) are drilled on a rear surface side of the housing to discharge a high air pressure (sound having a phase opposite to that in the front cavity) generated in the housing (back cavity) to the outside of the housing.

The sound guide part 1152 includes a hollow (for example, cylindrical) tube member having an inner diameter of 1 to 5 millimeters, and both ends thereof are open ends. One end of the sound guide part 1152 is a sound input hole for the sound generated from the sound generation part 1151, and the other end thereof is a sound output hole thereof. Thus, the sound guide part 1152 is in a one side open state with one end thereof attached to the sound generation part 1151. For example, the sound guide part 1152 can be fabricated with resin having elasticity, such as elastomer.

The tubular sound guide part 1152 has a bent shape. The tubular sound guide part 1152 is bent into a substantially U-shape near the middle thereof and folded back from the rear surface side to the front surface side of the auricle. Thus, as shown in FIG. 13, in a case where the sound pickup device 1100 is worn on the ear of the user, the sound output hole of the sound guide part 1152 is positioned in the vicinity of the entrance of the ear canal by the holding part, while the sound generation part 1151 is positioned on the back side of the auricle. The sound guide part 1152 is folded back at the lower end of the auricle because of the bent shape, and can propagate aerial vibration taken from the sound generation part 1151 on the back side of the auricle to the front side of the auricle.

The other end of the sound guide part 1152 joins with one part of the inner surface of the ring body 1121 of the holding part. In the example shown in FIG. 13, the ring body 1121 is inserted into the cavum concha and is in contact with the bottom surface of the cavum concha. In addition, the sound guide part 1152 joining with the ring body 1121 extends across a valley of the intertragic notch. The ring body 1121 is locked to the intertragic notch or an inner wall of a tragus so that the sound guide part 1152 is hooked on the valley of the intertragic notch. Thereby, the sound pickup device 1100 suitably fits in the auricle. In a state where the ring body 1121 is accommodated into the cavum concha and the sound guide part 1152 is locked so as to extend across the valley of the intertragic notch, the ring body 1121 supports the vicinity of the other end of the sound guide part 1152 so that the sound output hole at the other end of the sound guide part 1152 is oriented toward the entrance of the ear canal.

It should be understood that in a case where the sound pickup device 1100 fits in the cavum concha of the user, the relative position between the sound output hole of the sound output part 1150 and the microphone hole 1111 which is a sound pickup hole of the sound pickup part 1110 is kept constant. It should also be understood that in a case where the sound pickup device 1100 fits in the cavum concha of the user, as compared with the microphone hole 1111 which is the sound pickup hole of the sound pickup part 1110, the sound output hole of the sound output part 1150 is positioned outside the ear cavity of the user. The microphone hole 1111 is basically provided around the center of the opening of the ring body 1121.

It is preferable that the inner diameter of the sound guide part 1152 be as large as possible, in view of an object to propagate the aerial vibration. Meanwhile, as shown in FIG. 13, the sound guide part 1152 extends, in the vicinity of the other end thereof, across the valley of the intertragic notch. Therefore, if the outer diameter of the sound guide part 1152 is set to be greater than or equal to a gap of the intertragic notch (for example, 3.6 millimeters), then the valley of the intertragic notch is widened, which causes concern that the ear of the user is given a pressing feeling.

The ring body 1121 has a hollow structure, and almost all of the inner side thereof is the opening portion. In addition, the outer diameter of at least the vicinity of the other end of the sound guide part 1152 is formed to be smaller than an inner diameter of the ear cavity (near the entrance of the ear canal). Thus, even in a state where the ring body 1121 is inserted into the cavum concha, the ear cavity of the user is not closed. In addition, since the sound generation part 1151 is disposed at a location away from the ear cavity such as the back side of the ear of the user, it can be said that the sound output part 1150, the ear cavity of the user is open. It can be therefore said that the sound pickup device 1100 with the sound output part 1150 is of an ear cavity open type, and has a sound transmission performance.

Although the sound generation part 1151 is disposed at a location away from the ear cavity of the user, leakage of the sound generated therein to the outside can be prevented. This is because the other end of the sound guide part 1152 is provided so as to face toward the depth of the ear canal, and the aerial vibration of the generated sound is released by the perception of the eardrum, so that even if the output of the sound generation part 1151 is reduced, a sufficient sound quality can be obtained in the sound output hole of the sound guide part 1152.

In addition, the directivity of the aerial vibration emitted from the other end of the sound guide part 1152 also contributes to prevention of sound leakage. The aerial vibration is emitted from the other end of the sound guide part 1152 toward the inside of the ear canal. The ear canal is a hole starting from the entrance of the ear canal and ending inside the eardrum, in other words, is a cylindrical closed space of an S-shaped curve, and typically has a length of approximately 25 to 30 millimeters. The aerial vibration emitted from the other end of the sound guide part 1152 toward the depth of the ear canal reaches the eardrum with directivity, and the aerial vibration is partly reflected. In addition, since the sound pressure of the aerial vibration increases in the ear canal, the sensitivity (gain) of, particularly, a low frequency range is improved. On the other hand, the outside of the ear canal, namely, the external environment, is an open space. Thus, in a case where the aerial vibration emitted from the other end of the sound guide part 1152 to the outside of the ear canal is released to the external environment, the aerial vibration does not have the directivity and is steeply attenuated.

Strictly speaking, in a state where the ring body 1121 is locked to the intertragic notch, it is preferable that the other end of the sound guide part 1152, which is the sound output hole, face the cavum concha rather than the vicinity of the entrance of the ear canal. The ring body 1121 therefore supports the other end of the sound guide part 1152 at an angle so that the sound output hole is oriented toward the entrance of the ear canal. This is because, in order to keep the sensitivity of a low frequency range component, it is extremely important that the direction of sound emitted from the other end of the sound guide part 1152 coincides with the direction of the hole of the ear canal. In contrast, in a case where the ring body 1121 supports the other end of the sound guide part 1152 so that the other end of the sound guide part 1152 faces in the horizontal direction, most of the aerial vibration emitted from the other end of the sound guide part 1152 is reflected on the cavum concha, which makes the propagation in the ear canal difficult.

Figure 14:
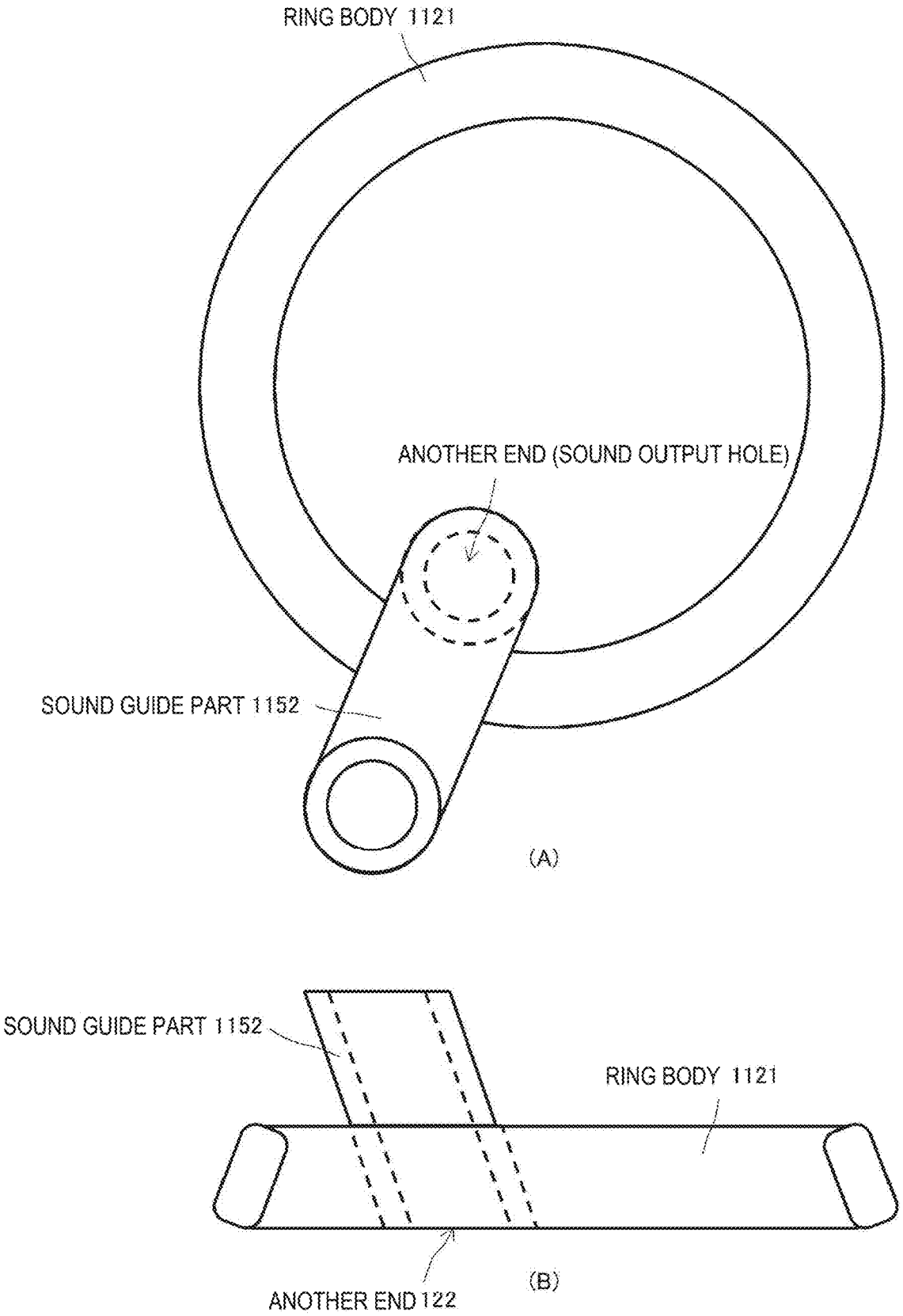
FIG. 14 illustrates a top plan view and a cross-sectional view of a ring body 1121 joining with another end of a sound guide part 1152 and its periphery.
Figure 15:
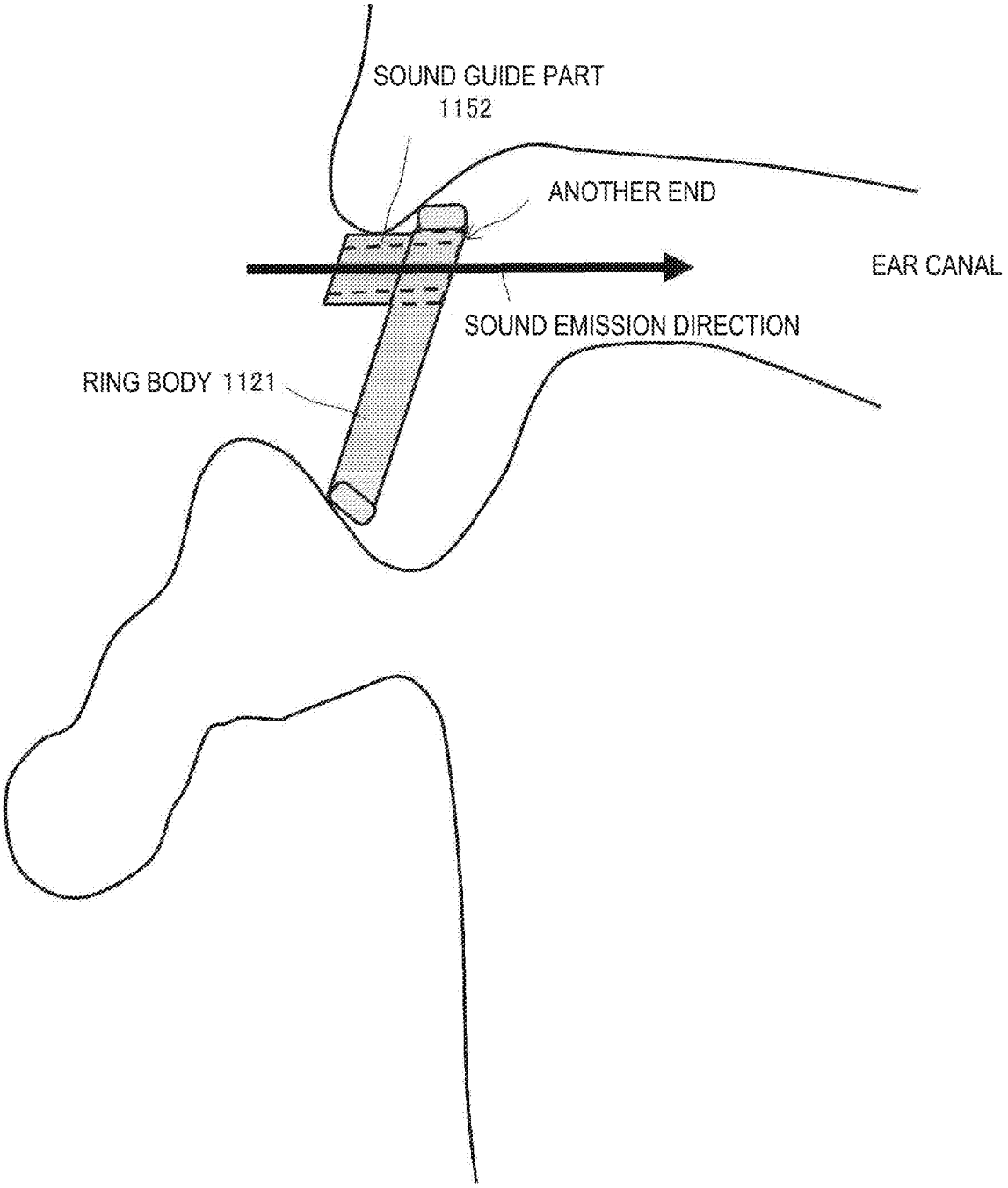
FIG. 15 is a diagram illustrating a horizontal section of a head of a user near the left ear with the ring body 1121 locked to an intertragic notch of the left ear.
Figure 16:
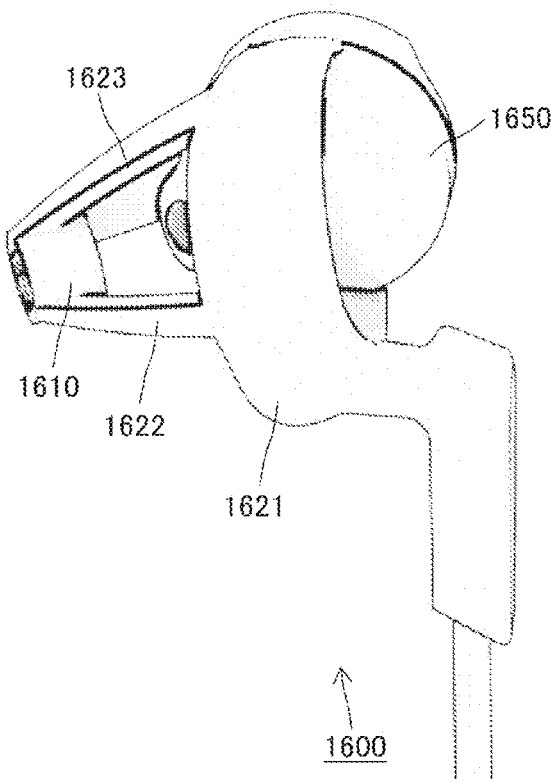
FIG. 16 is a diagram illustrating the external configuration of a sound pickup device 1600 with a sound output part.
Figure 17:
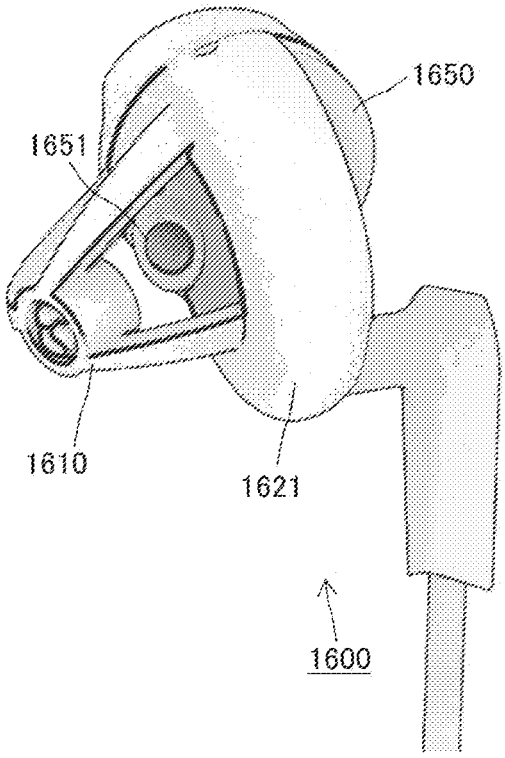
FIG. 17 is a diagram illustrating the external configuration of the sound pickup device 1600 with a sound output part.
Figure 18:
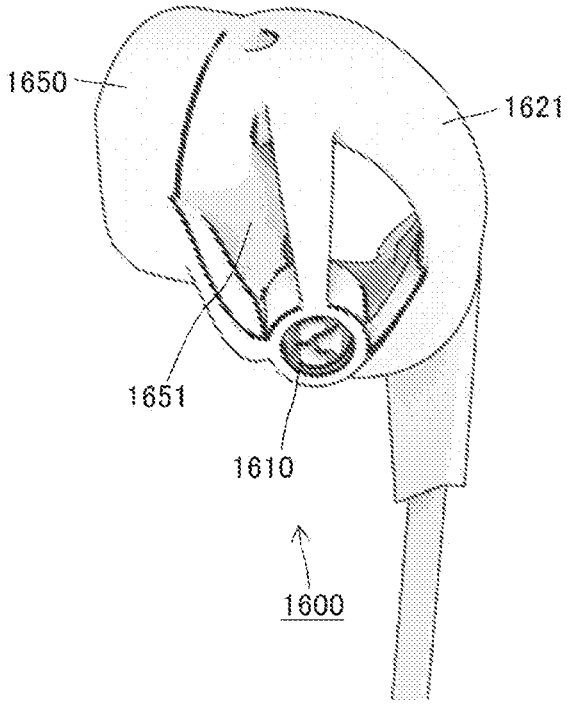
FIG. 18 is a diagram illustrating the external configuration of the sound pickup device 1600 with a sound output part.
Figure 19:
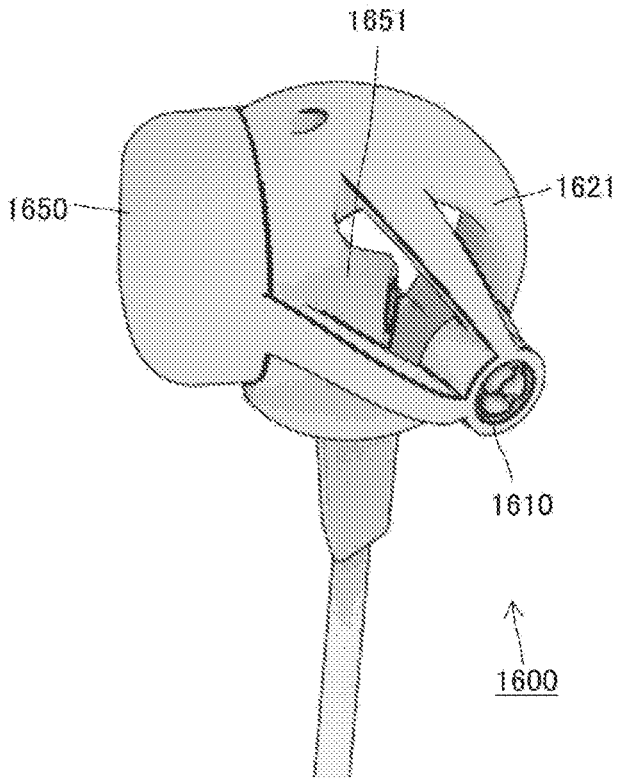
FIG. 19 is a diagram illustrating the external configuration of the sound pickup device 1600 with a sound output part.
Figure 20:
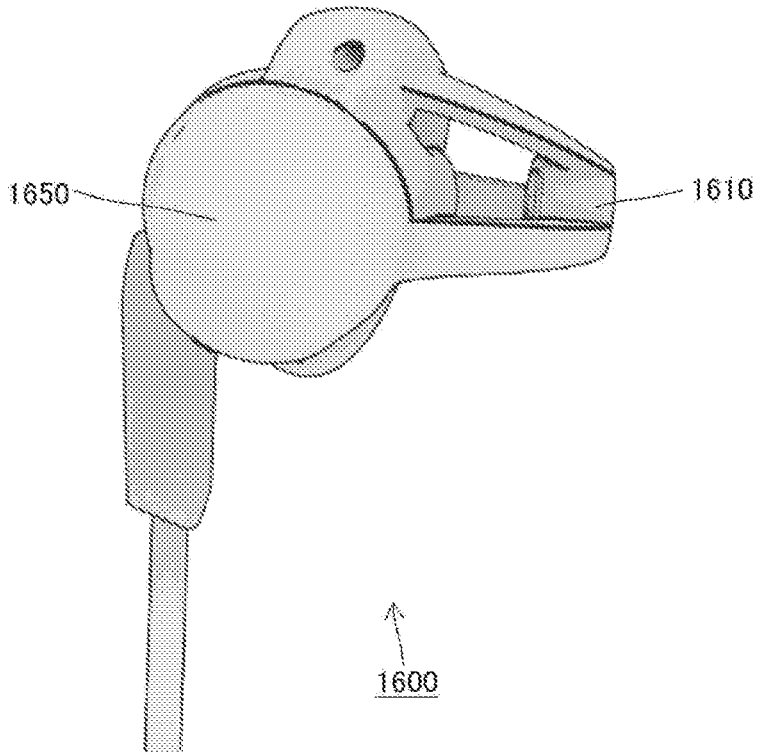
FIG. 20 is a diagram illustrating the external configuration of the sound pickup device 1600 with a sound output part.

FIG. 14 shows, in (A) and (B), a top plan view and a cross-sectional view of the ring body 1121 joining with the other end of the sound guide part 1152 and its periphery. FIG. 15 shows a horizontal section near the left ear of the head of the user with the ring body 1121 locked to the intertragic notch of the left ear. However, in each of FIG. 14 and FIG. 15, the sound pickup part 1110 and the arms 1122-1124 are omitted for purposes of simplicity of the drawings.

As already described with reference to FIG. 13, the ring body 1121 is inserted into the cavum concha, the sound guide part 1152 joining with the ring body 1121 extends across the valley of the intertragic notch, and the ring body 1121 is locked so as to be hooked on the intertragic notch. As can be seen from FIG. 15, when being locked to the intertragic notch or the inner wall of the tragus, the ring body 1121 is inclined from the direction of the hole of the ear canal; however, the sound output hole at the other end of the sound guide part 1152 is oriented toward the ear canal. In other words, the sound emission direction from the other end of the sound guide part 1152 coincides with the direction of the hole of the ear canal.

In a case where the sound pickup part 1110 of the sound pickup device 1100 with the sound output part 1150 is used singly, as described in Example 1, since the sound pickup part 1110 is of an ear cavity open type and has a sound transmission performance, binaural recording, calculation of a head-related transfer function, and virtual sound localization in light of the shape of the ear canal and the reflected sound from the eardrum can be implemented. Further, using the sound pickup part 1110 simultaneously at the time of sound reproduction by the sound output part 1150 enables noise cancelling in light of the shape of the ear canal and the reflected sound from the eardrum.

In addition, the sound pickup device 1100 with the sound output part 1150 has a feature that the sound output part 1150 alone is of an ear cavity open type. Advantages of the ear cavity open type sound output part 1150 are summarized below.

(1) The user can hear the ambient sound naturally even while the user wears the sound pickup device 1100 with the sound output part 1150. This allows the user to normally use the functions of human depending on auditory characteristics, such as space perception, danger sensing, and perception of conversation and subtle nuance of conversation.

(2) The sound pickup device 1100 with the sound output part 1150 does not close the ear cavity when being worn, which makes another person feel free to speak to the user. In addition, the user wearing the sound pickup device 1100 with the sound output part 1150 can constantly hear the ambient sound. Thus, if a person approaches the user, then the user takes, on the basis of sound information such as footsteps of the person, at least passive behavior, as nature of human, such as "turning the body to the direction of the sound", "turning his/her eyes toward the direction of the sound", or the like. Such behavior gives another person an impression of being "welcomed to speak to"; therefore communication between people is not inhibited.

(3) The sound pickup device 1100 with the sound output part 1150 is not influenced by a self-generated noise. In the fitting state in the ear cavity, the other end of the sound guide part 1152, which is the sound output hole, is not in contact with the inner wall of the ear canal. Thus, there is no influence of the user's own voice, heartbeat sound, chewing sound, sound when swallowing saliva, blood flow sound, breath sound, vibration sound transmitted through the body during walking, rustling sound of clothes by cord, and the like. In addition, no friction sound is generated between the earpiece and the inner wall of the ear canal. In addition, since the ear cavity is open, there is no concern about dampness in the ear canal.

(4) The sound pickup device 1100 with the sound output part 1150 has favorable fitting in the ear, and can absorb positioning variations due to, for example, individual differences in size and shape of the ears. The ring body 1121 is configured to be locked to the intertragic notch or the inner wall of the tragus and to hold so that the sound output hole at the other end of the sound guide part 1152 is oriented toward the entrance of the ear canal. This eliminates the need for length adjustment unlike the case of a behind-the-ear sound output device with a sound guide member folded back at the helix. In addition, the ring body 1121 is locked to the intertragic notch or the inner wall of the tragus so that the favorable fitting state can be maintained. In addition, the configuration in which the sound guide part 1152 is folded back at an earlobe from the back surface of the auricle and extends to the vicinity of the entrance of the ear canal does not cause the sound pickup device 1100 with the sound output part 1150 to interfere with other devices at all such as a pair of glasses, glass-type wearable device, or behind-the-ear device even if the user uses the sound pickup device 1100 with the sound output part 1150 together with these devices.

(5) The sound guide part 1152 propagates the sound generated in the sound generation part 1151 to the vicinity of the entrance of the ear canal in the shortest distance from behind the ear. Therefore, as compared with the behind-the-ear sound output device, the sound loss can be minimized by the shortened length of the sound guide part, and thus, it is possible to obtain a favorable sound quality with the output of the sound generation part 1151 made low. As an additional remark, the sound generation part 1151 has a high tolerance of dimensions, and can be designed according to the necessary sound band and sound pressure.

FIG. 16 to FIG. 20 show the appearance of a sound pickup device 1600 with a sound output part according to another configuration example, while changing the direction of viewing. Although FIG. 16 to FIG. 20 show only one of the left and right sound pickup devices 1600, it should be understood that a set of the left and right sound pickup devices 1600 with a sound output function are worn on the left and right ears of the user to implement binaural recording, binaural reproduction, noise cancelling, or the like.

The sound pickup device 1600 includes a sound pickup part 1610, a holding part for holding the sound pickup part 1610, and a sound output part 1650.

In the illustrated sound pickup device 1600, the sound pickup part 1610 and the holding part have substantially the same configuration as that of the sound pickup device 100 shown in FIG. 1. To be specific, the sound pickup part 1610 is a cylindrical microphone having a diameter of, for example, approximately 2.5 millimeters. The holding part includes a hollow ring body 1621 (in other words, ring body 1621 having an opening portion through which to transmit a sound) and a plurality of arms 1622, 1623 . . . for supporting the sound pickup part 1610. In the illustrated example, the ring body 1621 has an O-shape; however, may be a C-shape. Each of the arms is coupled to the ring body 1621 at one end thereof and supports the sound pickup part 1610 at the other end thereof. The sound pickup part 1610 is supported such that the sound pickup direction (or a microphone hole 1611 serving as a sound pickup hole) is oriented to the external environment rather than the depth of the ear canal (i.e., the eardrum side). It can also be said that it is preferable that the sound pickup direction of the sound pickup part 1610 be oriented to the outside of the ear canal rather than the depth of the ear canal (i.e., the eardrum side) or the inner wall side of the ear canal.

The following is the same as described above with reference to FIG. 1 or the like: the sound pickup part 1610 is of an ear cavity open type and has a sound transmission performance; the sound pickup part 1610 is supported at a location closer to the eardrum inside the ear canal and the ambient sound can be picked up in a state close to that of a sound heard by the user; and it is possible to perform binaural recording and determine a head-related transfer function in light of not only the parts of the human body such as the head, body, or earlobe of each user but also the shape of the ear canal and the influence of the reflected sound from the eardrum.

On the other hand, the sound output part 1650 contains a built-in sound generation part for generating a sound and also includes a short hollow tubular sound guide part 1651. The sound generation part includes a sound generation element for causing a sound pressure change such as a dynamic type driver having a diameter of approximately 9 millimeters, and the housing thereof is integrated with a part of the ring body 1621. In the example shown in FIG. 16 or the like, the housing of the sound output part 1650 joins with an outer surface of the ring body 1621; however, it is also conceivable to design the housing of the sound output part 1650 so as to join with an inner surface of the ring body 1621, or to join with the ring body 1621 in the vicinity of the center of the housing of the sound output part 1650 because the housing of the sound output part 1650 is compact. The ring body 1621 is, for example, approximately 13.5 millimeters in dimension and can fit in the cavum concha of the user. Although the size of the cavum concha varies from person to person, if the outer diameter (or width) of the ring body 1621 is set to be larger than 16 millimeters, then many people are not able to insert the ring body 1621 into the cavum concha. The sound guide part 1651 includes a short and hollow tube member which protrudes from the front surface of the sound output part 1650 (front surface side of a diaphragm (described later) disposed in the housing) in the direction of the entrance of the ear canal. An opening portion at the tip of the sound guide part 1651 serves as a sound output hole. The sound guide part 1651 outputs a sound generated by the sound output part 1650 toward the entrance of the ear canal.

Figure 21:
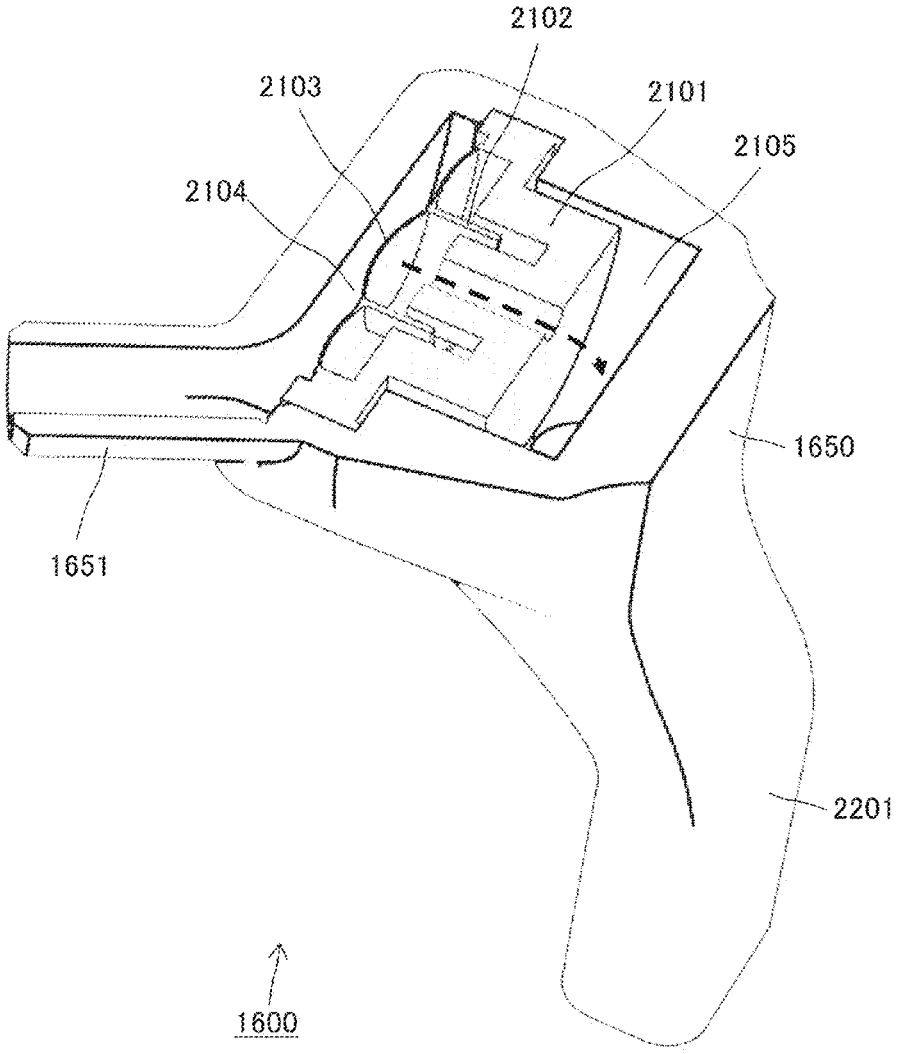
FIG. 21 is a diagram illustrating a cross section of a sound output part 1650.
Figure 22:
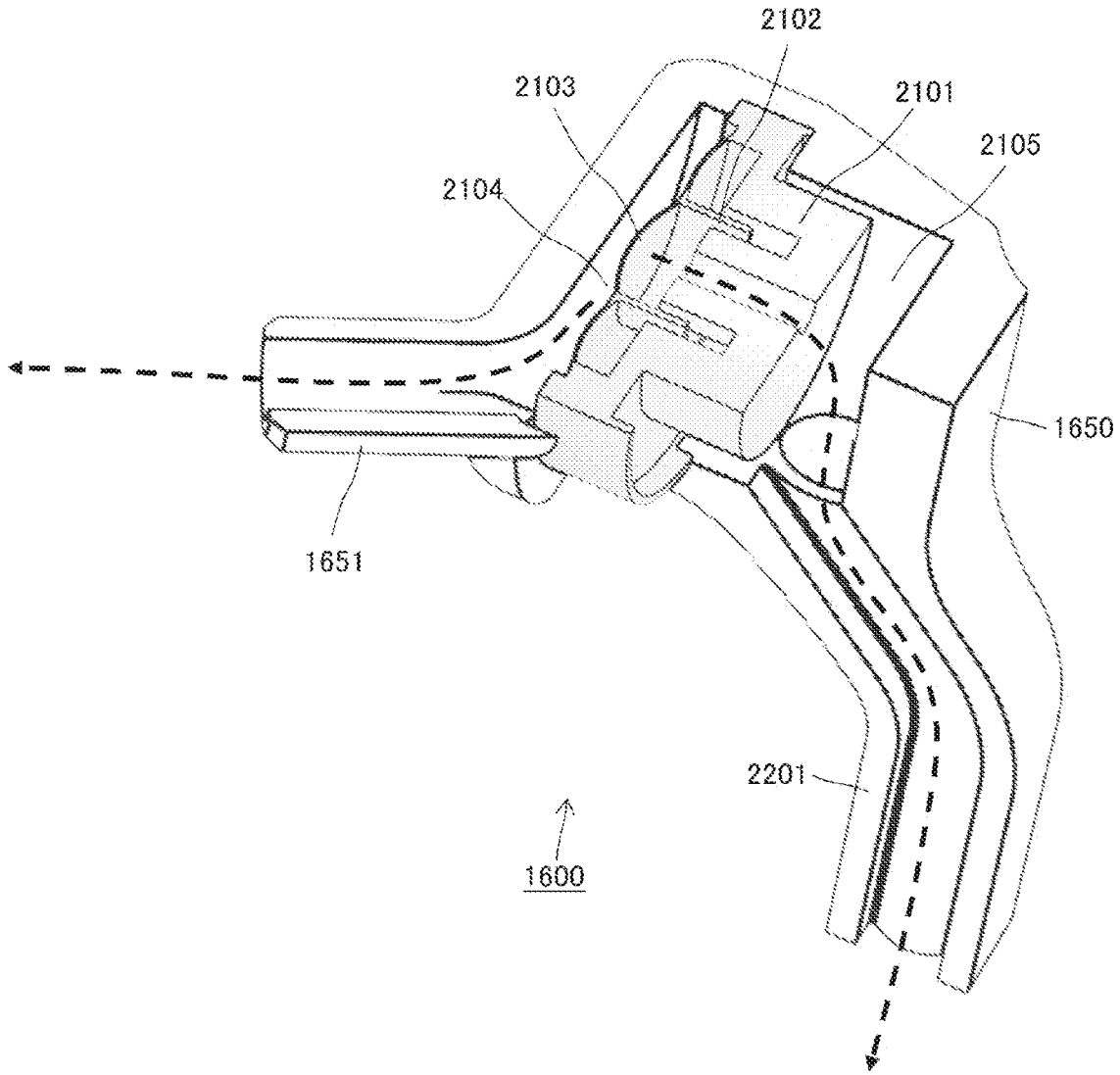
FIG. 22 is a diagram illustrating a cross section of the sound output part 1650.

FIG. 21 and FIG. 22 are cross sections of the sound output part 1650 and show the internal configuration of the housing. Note that FIG. 21 shows the cross section of, mainly, the sound output part, and FIG. 22 shows the cross section including an exhaust part (described later). For simplification of the drawings, the sound pickup part 1610 and the holding part are omitted appropriately. The sound generation element shown in FIG. 21 and FIG. 22 is basically a dynamic type driver; however, the sound generation element may be an electrostatic type driver for causing a sound pressure change in a similar manner. Alternatively, it is also possible to use a sound generation element which is completely different in type, such as a balanced-armature type or a piezoelectric type, or a hybrid type combining a plurality of types of sound generation elements.

Inside the sound output part 1650, a diaphragm 2103 having a voice coil 2102 is disposed so as to face an interior of a magnetic circuit including a magnet 2101. Further, the diaphragm 2103 partitions the inside of the sound output part 1650 into a diaphragm front space (front cavity) 2104 and a diaphragm rear space 2105 (back cavity). In a case where the magnetic field changes according to audio signals inputted to the voice coil 2102 via a signal line (not shown), the magnetic force of the magnet 2101 causes the diaphragm 2103 to move back and forth (the winding direction of the voice coil 2102); thereby, a change in air pressure occurs between the diaphragm front space 2104 and the diaphragm rear space 2105, which becomes a sound.

The sound generated in the diaphragm front space 2104 propagates inside a tube of the sound guide part 1651 and is emitted from the sound output hole of the tip thereof toward the depth of the ear canal, and thereafter, reaches the eardrum.

Meanwhile, in order that the sound generated in the diaphragm rear space 2105 (sound having a phase opposite to that of the diaphragm front space 2104) does not interfere with the vibration of the diaphragm 2103, an exhaust hole for emitting the sound to the outside of the housing of the sound output part 1650 is necessary.

It is assumed that the sound pickup device 1600 including the sound output part 1650 fits in the cavum concha of the user and is used (see below and FIG. 23). If the exhaust hole is drilled, for example, on the rear surface of the housing of the sound output part 1650, then the sound generated in the diaphragm rear space 2105 is emitted in the cavum concha, which is collected by the sound pickup part 1610 or becomes a large noise for a reproduced sound generated in the sound output part 1650.

To cope with this, as shown in FIG. 22, an exhaust part 2201 is provided on the rear surface side of the sound output part 1650 (diaphragm 2103). The exhaust part 2201 includes a hollow tube member having a sufficient length to extend from the rear surface side of the housing of the sound output part 1650 across the intertragic notch to reach outside of the auricle. An opening portion at the tip of the exhaust part 2201 serves as an exhaust hole for emitting the sound generated in the diaphragm rear space 2105. With this configuration, the exhaust part 2201 can emit the sound generated in the diaphragm rear space 2105 to the outside of the auricle, which is sufficiently away from the sound pickup part 1610 or the sound output hole at the tip of the sound guide part 1651, leading to the reduction in influence of sound leakage. Note that the exhaust part 2201 may also serve as a duct through which to insert a signal line for audio signals, power, and so on.

Figure 23:
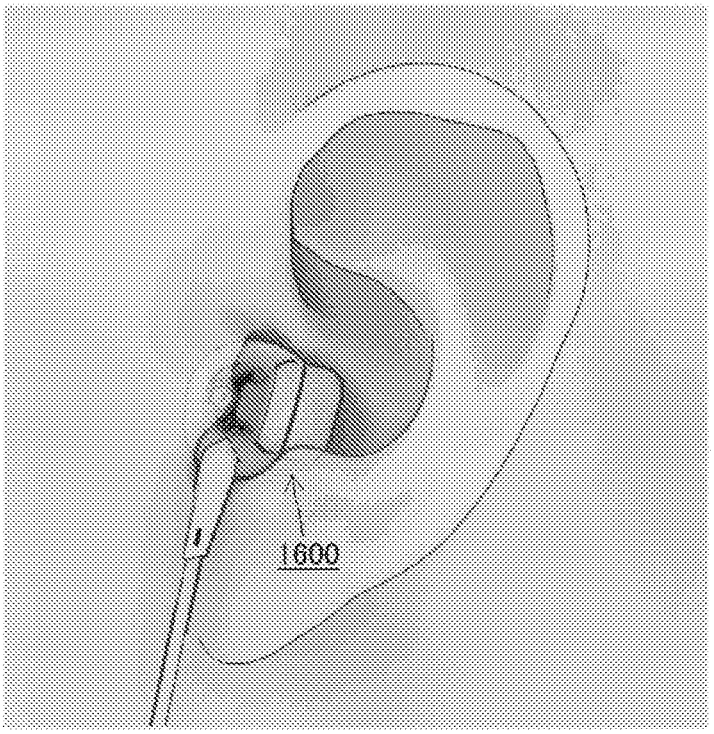
FIG. 23 is a diagram illustrating a state in which the sound pickup device 1600 with a sound output function fits in the left ear of a user.
Figure 24:
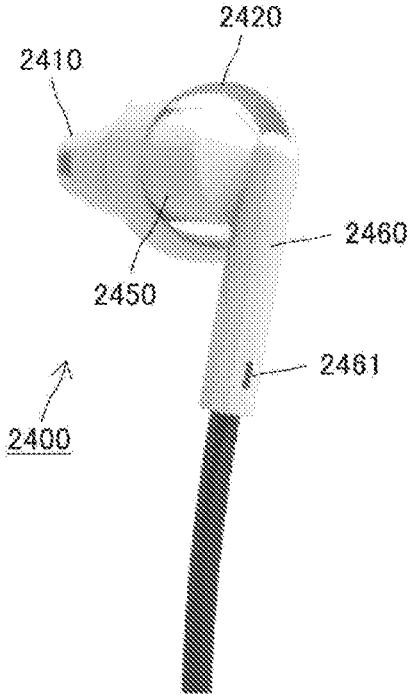
FIG. 24 is a diagram illustrating the external configuration of a sound pickup device 2400 with a sound output part.
Figure 25:
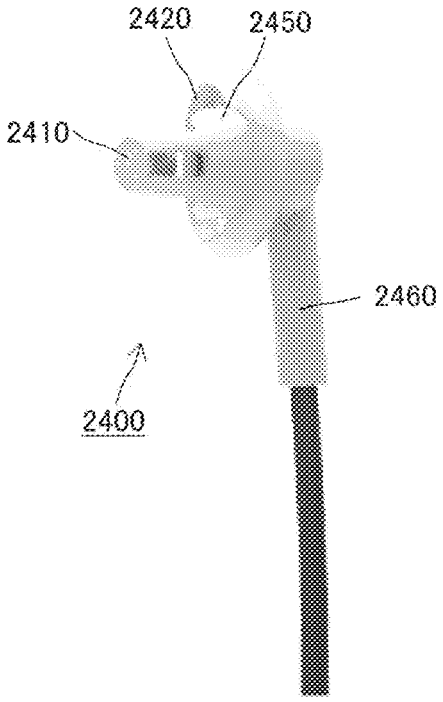
FIG. 25 is a diagram illustrating the external configuration of the sound pickup device 2400 with a sound output part.
Figure 26:
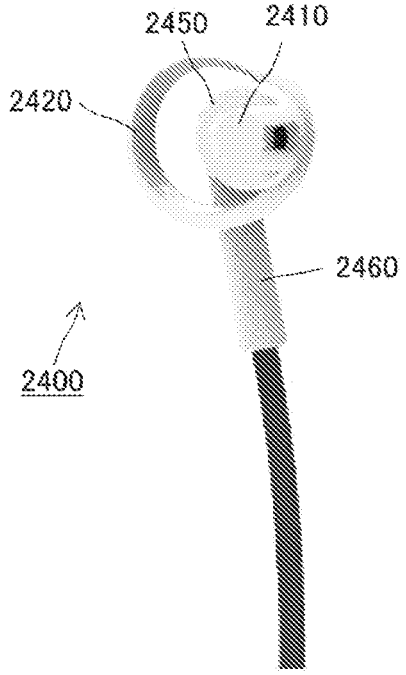
FIG. 26 is a diagram illustrating the external configuration of the sound pickup device 2400 with a sound output part.
Figure 27:
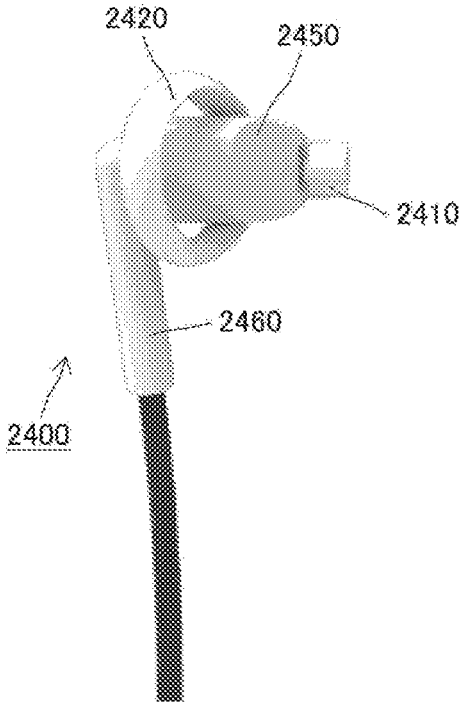
FIG. 27 is a diagram illustrating the external configuration of the sound pickup device 2400 with a sound output part.
Figure 28:
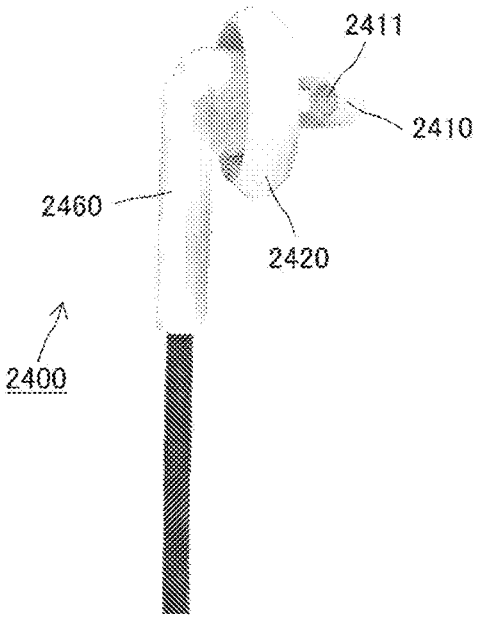
FIG. 28 is a diagram illustrating the external configuration of the sound pickup device 2400 with a sound output part.
Figure 29:
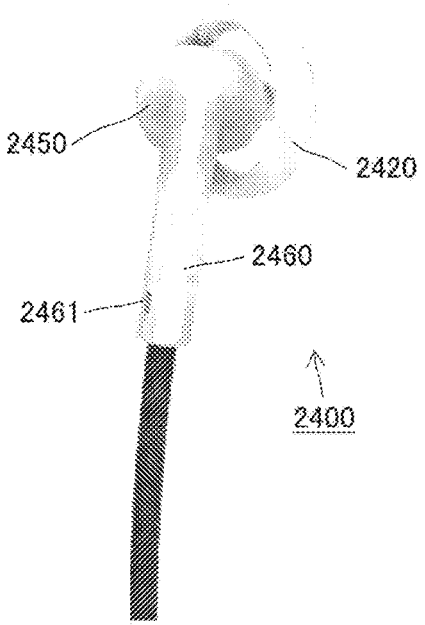
FIG. 29 is a diagram illustrating the external configuration of the sound pickup device 2400 with a sound output part.

FIG. 23 shows a state in which the sound pickup device 1600 with a sound output function fits in the left ear of the user. Unlike the sound pickup device 1100 shown in FIG. 11 or the like, it should be understood that, even in a case where the sound output part 1650 is configured integrally with the ring body 1620, the entire sound pickup device 1100 can fit in the cavum concha of the user because the sound output part 1650 is small with a diameter of approximately 9 millimeters.

In the example shown in FIG. 23, the ring body 1621 is inserted into the cavum concha together with the integrated sound output part 1650, and is in contact with the bottom surface of the cavum concha. In addition, the exhaust part 2201 protruding from the rear surface of the housing of the sound output part 1650 extends across a valley of the intertragic notch. The ring body 1621 is locked to the intertragic notch or the inner wall of the tragus so that the exhaust part 2201 is hooked on the valley of the intertragic notch. Thereby, the sound pickup device 1600 suitably fits in the auricle.

In addition, as shown in FIG. 23, in a state where the ring body 1621 inserted into the cavum concha is locked to the intertragic notch or the inner wall of the tragus, the sound guide part 1651 protrudes from the front surface of the housing of the sound output part 1650 so that the sound output hole at the tip of the sound guide part 1651 is oriented toward the entrance of the ear canal, which is hidden in FIG. 23.

It should be understood that in a case where the sound pickup device 1600 fits in the cavum concha of the user, the relative position between the sound output hole of the sound output part 1650 and the microphone hole 1611 which is the sound pickup hole of the sound pickup part 1610 is kept constant. It should also be understood that in a case where the sound pickup device 1600 fits in the cavum concha of the user, the sound output hole of the sound output part 1650 is positioned outside the ear cavity of the user, as compared with the microphone hole 1611 which is the sound pickup hole of the sound pickup part 1610. The microphone hole 1611 is basically provided around the center of the opening of the ring body 1621.

It is preferable that the inner diameter of the exhaust part 2201 be as large as possible, in view of an object to emit an unnecessary sound (sound, generated in the back cavity, having a phase opposite to that of the front cavity) to the outside of the housing of the sound output part 1650 and the use of the exhaust part 2201 as the duct for the signal line. Meanwhile, as shown in FIG. 23, the exhaust part 2201 extends across the valley of the intertragic notch. Therefore, if the outer diameter of the exhaust part 2201 is set to be greater than or equal to a gap of the intertragic notch (for example, 3.6 millimeters), then the valley of the intertragic notch is widened, which causes concern that the ear of the user is given a pressing feeling.

The ring body 1621 has a hollow structure, and almost all of the inner side thereof is the opening portion. Since being integrated with a part of the ring body 1621, the housing of the sound output part 1650 does not interfere at all with the opening portion of the inner side of the ring body 1621. Thus, even in a state where the entire sound pickup device 1600 integrated with the sound output part 1650 is inserted into the cavum concha, the ear cavity of the user is not closed. It can be therefore said that the ear cavity of the user is open, the sound pickup device 1600 with the sound output part 1650 is of an ear cavity open type, and has a sound transmission performance.

Since the sound output part 1650 is disposed in the cavum concha, a sufficient sound quality can be obtained in the sound output hole at the tip of the sound guide part 1651 even if the output of the sound output part 1650 is reduced. It is therefore possible to prevent leakage of the sound generated in the sound output part 1650 to the outside.

In addition, the directivity of the aerial vibration emitted from the tip of the sound guide part 1651 also contributes to prevention of sound leakage. The aerial vibration is emitted from the tip of the sound guide part 1651 toward the inside of the ear canal. The ear canal is a cylindrical closed space of an S-shaped curve, and typically has a length of approximately 25 to 30 millimeters. The aerial vibration emitted from the tip of the sound guide part 1651 toward the depth of the ear canal reaches the eardrum with directivity, and the aerial vibration is partly reflected. In addition, since the sound pressure of the aerial vibration increases in the ear canal, the sensitivity (gain) of, particularly, a low frequency range is improved. On the other hand, the outside of the ear canal, namely, the external environment, is an open space. Thus, in a case where the aerial vibration emitted from the tip of the sound guide part 1651 to the outside of the ear canal is released to the external environment, the aerial vibration does not have the directivity and is steeply attenuated. In a state where the ring body 1621 is locked to the intertragic notch, it is preferable that the tip of the sound guide part 1651, serving as the sound output hole, face the cavum concha rather than the vicinity of the entrance of the ear canal.

In a case where the sound pickup part 1610 of the sound pickup device 1600 with the sound output part 1650 is used singly, as described in Example 1, since the sound pickup part 1610 is of an ear cavity open type and has a sound transmission performance, binaural recording, calculation of a head-related transfer function, and virtual sound localization in light of the shape of the ear canal and the reflected sound from the eardrum can be implemented. Further, using the sound pickup part 1610 simultaneously at the time of sound reproduction by the sound output part 1650 enables noise cancelling in light of the shape of the ear canal and the reflected sound from the eardrum.

In addition, the sound pickup device 1600 with the sound output part 1650 has a feature that the sound pickup device 1600 alone is of an ear cavity open type. Thus, as with the sound pickup device 1100, the sound pickup device 1600 with the sound output part 1650 has the advantages described above.

Figure 30:
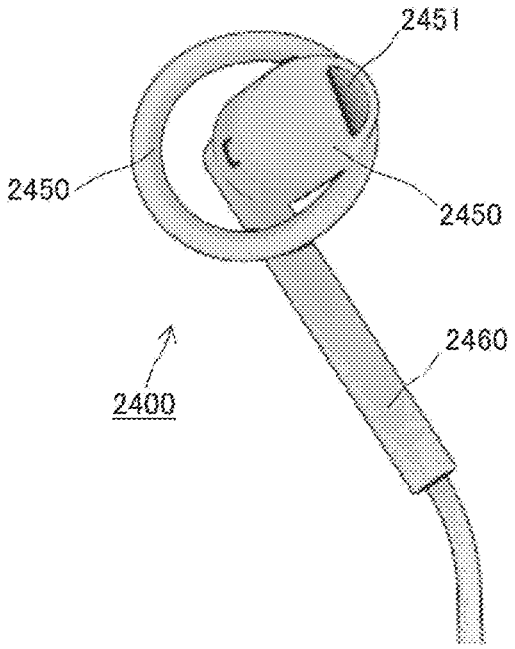
FIG. 30 is a diagram illustrating a front view of a sound output part (sound output side) with a sound pickup part of the sound pickup device 2400 and a mounting part thereof omitted.

FIG. 24 to FIG. 29 show the appearance of a sound pickup device 2400 with a sound output part according to yet another configuration example, while changing the direction of viewing. In addition, for reference, FIG. 30 shows a front view of a sound output part (sound output side) with a sound pickup part and a mounting part thereof omitted. Although FIG. 24 to FIG. 29 show only one of the left and right sound pickup devices 2400, it should be understood that a set of the left and right sound pickup devices 2400 with a sound output function are worn on the left and right ears of the user to implement binaural recording, binaural reproduction, noise cancelling, or the like.

The sound pickup device 2400 includes a sound pickup part 2410, a holding part 2420 for holding the sound pickup part 2410, and a sound output part 2450.

The sound output part 2450 includes a sound generation element for causing a sound pressure change such as a dynamic type driver having a diameter of approximately 6 millimeters, a housing thereof has a disk-like shape, and integrally joins with a part of the ring-like holding part 2420. In the illustrated example, the holding part 2420 has an O-shaped ring; however, the holding part 2420 may have a C-shape. In the example shown in FIG. 24 or the like, the housing of the sound output part 2450 joins with an inner surface of the ring-like holding part 2420; however, it is also conceivable to design the housing of the sound output part 2450 so as to join with an outer surface of the ring-like holding part 2420, or to join with the ring-like holding part 2420 in the vicinity of the center of the housing of the sound output part 2450 because the housing of the sound output part 2450 is compact. The holding part 2420 is, for example, approximately 13.5 millimeters in dimension and can fit in the cavum concha of the user. Although the size of the cavum concha varies from person to person, if the outer diameter (or width) of the holding part 2420 is set to be larger than 16 millimeters, then many people are not able to insert the holding part 2420 into the cavum concha. The sound output part 2450 includes a crescent sound output hole 2451 for outputting a generated sound drilled on the front surface of the sound output part 2450 (front surface side of a diaphragm (not shown) disposed in the housing).

Meanwhile, the sound pickup part 2410 has substantially the same configuration as that of the sound pickup part 110 of the sound pickup device 100 shown in FIG. 1. To be specific, the sound pickup part 2410 is a microphone having a cylindrical shape with a diameter of, for example, approximately 2.5 millimeters. The sound pickup part 2410 is supported by a plurality of the ring-like holding parts 2420 (two ring-like holding parts in the illustrated example) so as to protrude forward (in the direction of the depth of the ear canal when the sound pickup device 2400 is worn on the ear of the user) from the front surface of the housing of the sound output part 2450. In addition, the sound pickup part 2410 is so supported that the sound pickup direction (alternatively, a microphone hole 2411 serving as a sound pickup hole) is oriented not to the depth of the ear canal (i.e., the eardrum side) but to the external environment (see FIG. 28). It can also be said that it is preferable that the sound pickup direction of the sound pickup part 2410 be oriented to the outside of the ear canal rather than the depth of the ear canal (i.e., the eardrum side) or the inner wall side of the ear canal.

The following is the same as described above with reference to FIG. 1 or the like: the sound pickup part 2410 is of an ear cavity open type and has a sound transmission performance; the sound pickup part 2410 is supported at a location closer to the eardrum inside the ear canal and the ambient sound can be picked up in a state close to that of a sound heard by the user; and it is possible to perform binaural recording and determine a head-related transfer function in light of not only the parts of the human body such as the head, body, or earlobe of each user but also the shape of the ear canal and the influence of the reflected sound from the eardrum.

The illustration and detailed description of the internal configuration of the sound output part 2450 are omitted. Basically, as with FIG. 21 and FIG. 22, in the housing of the sound output part 2450, a diaphragm having a voice coil is disposed so as to face a magnetic circuit including a magnet, the magnetic field changes in a case where audio signals are inputted to the voice coil, the magnetic force of the magnet causes the diaphragm to move back and forth; thereby, a sound is generated in the diaphragm front space.

The sound generated in the sound generation element of the sound output part 2450 is emitted, toward the depth of the ear canal, from the sound output hole drilled on the front surface of the housing of the sound output part 2450, and then the sound reaches the eardrum.

As can be seen from FIG. 30, in the housing of the sound output part 2450, the sound output hole 2451 having a crescent shape is drilled not at the center of the ring-like holding part 2420 but at a position close to the periphery thereof. The sound output hole 2451 is positioned outside the ring-like holding part 2420 as compared with the microphone hole 2411 of the sound pickup part 2410. This is because a reproduced sound emitted from the sound output hole 2451 is prevented from interfering with an ambient sound that is conveyed from the external environment to the ear canal and is collected by the sound pickup part 2410. If the sound output hole 2451 is drilled in the vicinity of the center of the ring of the holding part 2420 on the front surface of the housing of the sound output part 2450, then the sound output hole 2451 faces, at a close distance to, the microphone hole 2411 of the sound pickup part 2410. This probably causes the sound pickup part 2410 to pick up not the ambient sound but the reproduced sound of the sound output part 2450.

A duct 2460 through which to insert a signal line for audio signals or power is coupled to the rear surface side of the housing of the sound output part 2450. In a case where the sound output part 2450 is a sound generation element for causing an air pressure change such as a dynamic type driver or an electrostatic type driver, it is necessary to discharge a high pressure (sound having a phase opposite to that of the front cavity) generated in the housing (back cavity) to the outside of the housing, in such a case, the duct 2460 can be used also as the exhaust part. An exhaust hole 2461 for emitting such a sound is drilled, on the duct 2460, at a location away from the holding part 2420 (see FIG. 29). Since the exhaust hole 2461 is sufficiently away from the sound pickup part 2410 or the sound output hole 2451, the sound discarded is not collected by the sound pickup part 2410 or does not become a noise for a reproduced sound of the sound output part 2450.

Figure 31:
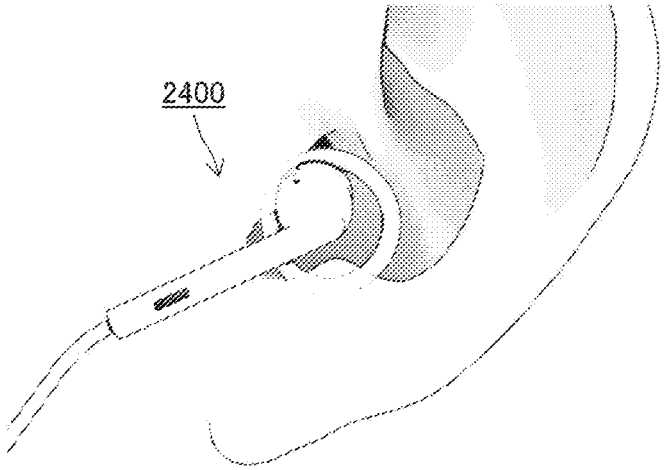
FIG. 31 is a diagram illustrating a state in which the sound pickup device 2400 with a sound output function fits in the left ear of a user.

FIG. 31 shows a state in which the sound pickup device 2400 with a sound output part fits in the left ear of the user. As with the sound pickup device 1600 shown in FIG. 16, it should be understood that since the sound output part 2450 is small with a diameter of approximately 6 millimeters, the ring-like holding part 2420 integrated with the sound output part 2450 can fit in the cavum concha of the user.

In the example shown in FIG. 31, the ring-like holding part 2420 is inserted into the cavum concha and is in contact with the bottom surface of the cavum concha. In addition, the sound output part 2450 joins with one part of the inner surface of the holding part 2420, and further, the duct 2460 coupled to the rear surface of the housing of the sound output part 2450 extends across the valley of the intertragic notch. The holding part 2420 is locked to the intertragic notch or the inner wall of the tragus such that the duct 2460 is hooked on the valley of the intertragic notch. Thereby, the sound pickup device 2400 suitably fits in the auricle.

Further, it should be understood that, as shown in FIG. 31, in a state where the holding part 2420 inserted into the cavum concha is locked to the intertragic notch or the inner wall of the tragus, the sound output hole 2451 is drilled on the front surface of the housing of the sound output part 2450 so that the sound output hole 2451 is oriented toward the entrance of the ear canal.

It should be understood that in a case where the sound pickup device 2400 fits in the cavum concha of the user, the relative position between the sound output hole of the sound output part 2450 and the microphone hole 2411 which is the sound pickup hole of the sound pickup part 2410 is kept constant. It should also be understood that in a case where the sound pickup device 2400 fits in the cavum concha of the user, as compared with the microphone hole 2411 which is the sound pickup hole of the sound pickup part 2410, the sound output hole of the sound output part 2450 is positioned outside the ear cavity of the user. The microphone hole 2411 is basically provided around the center of the opening of the ring body 2421.

It is preferable that the inner diameter of the duct 2460 be as large as possible in view of the fact that the duct 2460 is used also as an emission part for emitting an unnecessary sound. Meanwhile, as shown in FIG. 31, the duct 2460 extends across the valley of the intertragic notch. Therefore, if the outer diameter of the duct 2460 is set to be greater than or equal to the gap of the intertragic notch (for example, 3.6 millimeters), then the valley of the intertragic notch is widened, which causes concern that the ear of the user is given a pressing feeling.

The holding part 2420 has a ring-like shape, namely, a hollow structure, and almost all of the inner side thereof is an opening portion. In addition, although the housing of the small sound output part 2450 joins with one part of the inner surface of the holding part 2420, the housing of the small sound output part 2450 does not interfere with the opening of the holding part 2420. Thus, even in a state where the entire sound pickup device 2400 integrated with the sound output part 2450 is inserted into the cavum concha, the ear cavity of the user is not closed. It can be therefore said that the ear cavity of the user is open, the sound pickup device 2400 with the sound output part 2450 is of an ear cavity open type, and has a sound transmission performance.

Since the sound output part 2450 is disposed in the cavum concha, a sufficient sound quality can be obtained in the sound output hole 2451 even if the output of the sound output part 2450 is reduced. It is therefore possible to prevent leakage of the sound generated in the sound output part 2450 to the outside.

In addition, the directivity of the aerial vibration emitted from the sound output hole 2451 also contributes to prevention of sound leakage. The aerial vibration is emitted from the sound output hole 2451 toward the inside of the ear canal. The ear canal is a cylindrical closed space of an S-shaped curve, and typically has a length of approximately 25 to 30 millimeters. The aerial vibration emitted from the sound output hole 2451 toward the depth of the ear canal reaches the eardrum with the directivity, and the aerial vibration is partly reflected. In addition, since the sound pressure of the aerial vibration increases in the ear canal, the sensitivity (gain) of, particularly, a low frequency range is improved. On the other hand, the outside of the ear canal, namely, the external environment, is an open space. Thus, in a case where the aerial vibration emitted from the sound output hole 2451 to the outside of the ear canal is released to the external environment, the aerial vibration does not have the directivity and is steeply attenuated. In a state where the ring-like holding part 2420 is locked to the intertragic notch, it is preferable that the sound output hole 2451 face the cavum concha rather than the vicinity of the entrance of the ear canal.

In a case where the sound pickup part 2410 of the sound pickup device 2400 with the sound output part 2450 is used singly, as described in Example 1, since the sound pickup part 2410 is of an ear cavity open type and has a sound transmission performance, binaural recording, calculation of a head-related transfer function, and virtual sound localization in light of the shape of the ear canal and the reflected sound from the eardrum can be implemented. Further, using the sound pickup part 2410 simultaneously at the time of sound reproduction by the sound output part 2450 enables noise cancelling in light of the shape of the ear canal and the reflected sound from the eardrum.

In addition, the sound pickup device 2400 with the sound output part 2450 has a feature that the sound output part 2450 alone is of an ear cavity open type. Thus, as with the sound pickup device 1100, the sound pickup device 2400 with the sound output part 2450 has the advantages described above.

Figure 34:
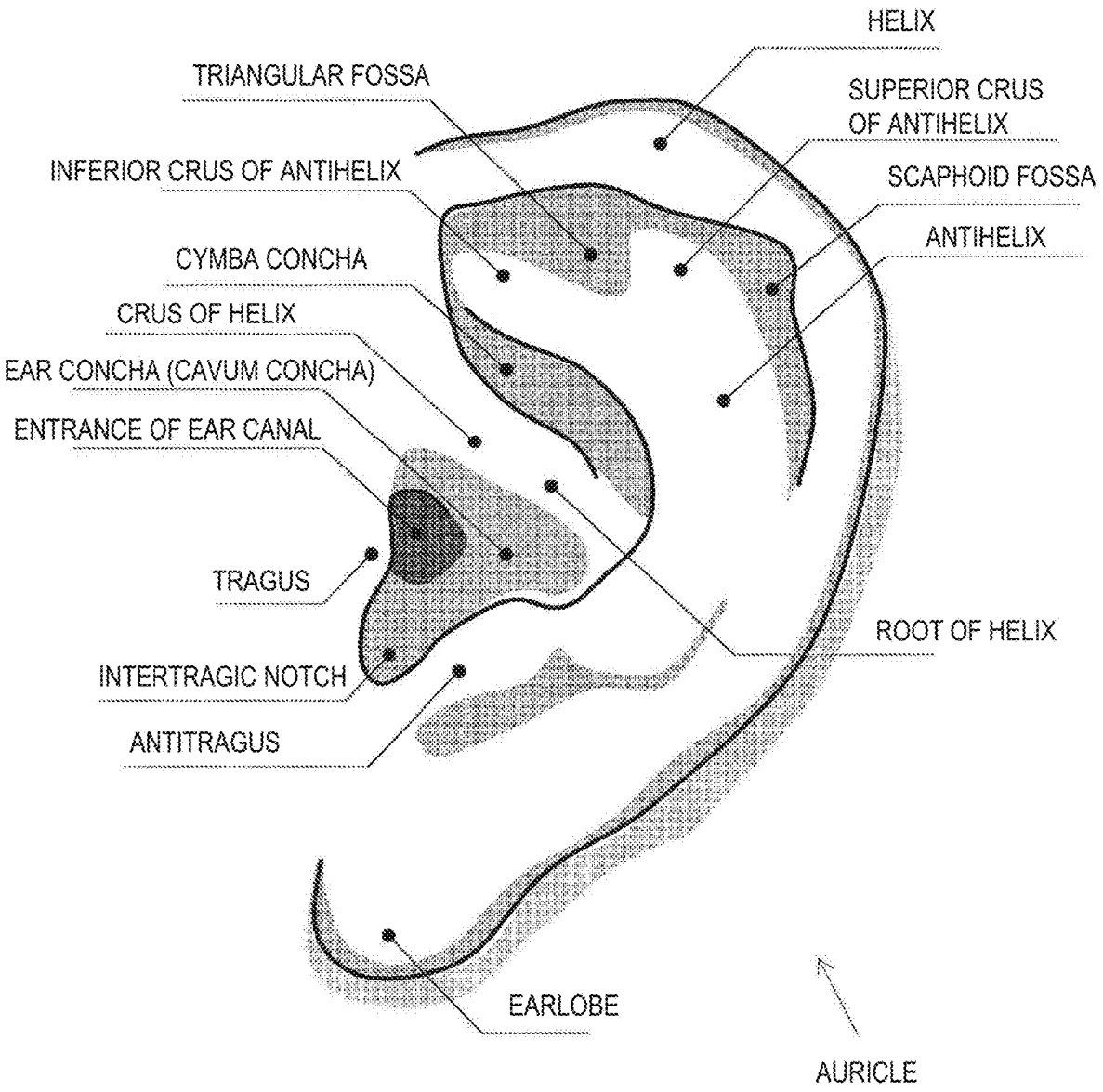
FIG. 34 is a diagram illustrating the shape of an auricle and a name of each part of the auricle.

For reference, the structure of the auricle is described with reference to FIG. 34. Broadly speaking, the structure of the auricle includes, in order from the outside, the helix, antihelix, ear concha, and tragus. In addition, on the outside of the tragus, the antitragus is present which is a projection to be paired with the tragus. A notch between the tragus and the antitragus is the intertragic notch. In addition, the lower end of the auricle is the earlobe.

The helix is a portion which forms the contour of the ear at the outermost periphery of the ear. The helix curves inward in the vicinity of the center of the auricle (the vicinity of the upper part of the entrance of the ear canal), and then, runs substantially horizontally in the vicinity of the center of the auricle to form a protrusion which vertically separates the ear concha. The crus of helix is the vicinity where the helix curves toward the inside of the auricle. The root of helix is a portion where the crus of helix further enters the ear concha.

The antihelix is a ridge line extending upward from the antitragus, and also corresponds to the rim of the ear concha. The ridge line forming the antihelix is bifurcated, and the upper branch is called the superior crus of antihelix which corresponds to the upper side of the triangular fossa. Further, the lower branch is called the inferior crus of antihelix which corresponds to the lower side of the triangular fossa.

The ear concha is the most recessed portion at the center of the ear, and is separated, with respect to the root of helix, into the cymba concha which is an elongated recess in the upper half and the cavum concha in the lower half. In addition, there is the entrance of the ear canal in the vicinity of the tragus of the cavum concha.

The triangular fossa is a triangular recess with three sides of the superior crus of antihelix, the inferior crus of antihelix, and the helix. In addition, the scaphoid fossa is a recess between the antihelix and the helix, and a recess at the outer upper portion in terms of the entire auricle.

INDUSTRIAL APPLICABILITY

The technology disclosed in the present specification has been described in detail above with reference to the specific embodiment. However, it will be obvious to those skilled in the art that modification and replacement of the embodiment can be made without departing from the scope of the technology disclosed in the present specification.

The sound pickup device and the sound pickup device with a sound output function to which the technology disclosed in the present specification is applied are worn on an ear of a user and used; however are significantly different from a conventional binaural microphone or earphone in terms of "ear cavity open type". Thus, the sound pickup device to which the technology disclosed in the present specification is applied can implement listening characteristic of an ambient sound, even in the fitting state, equivalent to that in a non-fitting state, implement precise binaural recording in light of the influence of diffraction or reflection on the inner wall of the ear canal and reflection on the eardrum, and determine a head-related transfer function with high accuracy representing a change in sound in light of the shape of the ear canal and the influence of a sound reflected from the eardrum. In addition, even in a state where being worn on an ear, the sound pickup device and the sound pickup device with a sound output function to which the technology disclosed in the present specification is applied have a feature that the ear cavity of the user appears not to be closed to the people around.

In short, the technology disclosed in the present specification has been described in an illustrative form, and the description of the present specification should not be interpreted in a limited manner. The claims should be taken into account to judge the gist of the technology disclosed in the present specification.

Additionally, the present technology may also be configured as below.

(1)

A sound pickup device including:

a sound pickup part; and a holding part that includes a sound transmission part and is configured to hold the sound pickup part in an ear canal of a user.

(2)

The sound pickup device according to (1), in which the holding part includes a ring body having an opening portion that serves as the sound transmission part, and one or more arms each of which has one end coupled to the ring body and another end supporting the sound pickup part.

(3)

The sound pickup device according to (2), in which the ring body is inserted into a cavum concha of the user and is locked in a vicinity of an intertragic notch.

(4)

The sound pickup device according to (1), in which the holding part includes an elastic member having a vent portion that serves as the sound transmission part.

(5)

The sound pickup device according to (1), in which the holding part includes a star-like member having an opening portion that serves as the sound transmission part, and one or more arms each of which has one end coupled to the star-like member and another end supporting the sound pickup part.

(6)

The sound pickup device according to any of (1) to (5), in which the holding part holds the sound pickup part so that a microphone hole is oriented to outside of the ear canal.

(7)

The sound pickup device according to any of (1) to (6), in which the holding part holds the sound pickup part so that a microphone hole is positioned on a farther side of an entrance of the ear canal.

(8)

The sound pickup device according to any of (1) to (7), further including a sound output part.

(9)

The sound pickup device according to (8), in which, in a case where the sound pickup device fits in an ear of the user, a relative position between a sound output hole of the sound output part and a sound pickup hole of the sound pickup part is kept constant.

(10)

The sound pickup device according to (8) or (9), in which, in a case where the sound pickup device fits in an ear of the user, a sound output hole of the sound output part is positioned outside an ear cavity as compared with a sound pickup hole of the sound pickup part.

(11)

The sound pickup device according to (8) or (10), in which the sound output part includes a sound generation part, and a sound guide part that has a hollow structure and is configured to capture a sound generated by the sound generation part from one end to propagate the sound to another end.

(12)

The sound pickup device according to (11), in which the sound generation part is placed on a rear surface of an ear of the user, said one end of the sound guide part is connected to the sound generation part, and the holding part holds a sound output hole at said another end of the sound guide part in an auricle of the user.

(13)

The sound pickup device according to (12), in which the sound guide part is inserted in an intertragic notch in a vicinity of said another end.

(14)

The sound pickup device according to (8) or (10), in which the sound output part is integrated with a part of the holding part including a ring body.

(15)

The sound pickup device according to (14), in which a housing of the sound output part includes a sound guide part that projects toward a direction of an entrance of the ear canal in a state where the ring body is inserted in a cavum concha of the user and has a sound output hole at a tip of the sound guide part.

(16)

The sound pickup device according to (8) or (10), in which the sound output part joins with an inner surface of the holding part including a ring body.

(17)

The sound pickup device according to (16), further including a sound output hole provided on a front surface side of a housing of the sound output part.

(18)

The sound pickup device according to (14) or (17), further including an exhaust part on a rear surface of a housing of the sound output part.

(19)

The sound pickup device according to (18), in which the exhaust part has an exhaust hole that extends from a rear surface side of the housing across an intertragic notch to outside of an auricle.

(20)

The sound pickup device according to (18) or (19), further including a signal line inserted through the exhaust part.

REFERENCE SIGNS LIST

100 sound pickup device
110 sound pickup part
111 microphone hole
121 ring body
122-124 arm
700 sound pickup device
710 sound pickup part
711 microphone hole
720 holding part
900 sound pickup device
910 sound pickup part
911 microphone hole
921 star-like member
922-926 arm
1100 sound pickup device (with sound output function)
1110 sound pickup part
1111 microphone hole
1121 ring body
1122, 1123 arm
1150 sound output part
1151 sound generation part
1152 sound guide part
1600 sound pickup device (with sound output function)
1610 sound pickup part
1611 microphone hole
1621 ring body
1622, 1623 arm
1650 sound output part
1651 sound guide part
2101 magnet
2102 voice coil
2103 diaphragm
2201 exhaust part
2400 sound pickup device
2410 sound pickup part
2411 microphone hole
2420 holding part
2450 sound output part
2451 sound output hole
2460 duct
2461 exhaust hole

The invention claimed is:

1. A sound pickup device comprising: a sound pickup part; a holding part that includes a sound transmission part and is configured to hold the sound pickup part in an ear canal of a user, wherein the holding part includes a ring body having an opening portion that serves as the sound transmission part, and one or more arms each of which has one end coupled to the ring body and another end supporting the sound pickup part; and a sound output part including a sound generation part and a sound guide part, wherein the sound generation part is disposed in a housing directly attached to the ring body.

2. The sound pickup device according to claim 1, wherein the ring body is inserted into a cavum concha of the user and is locked in a vicinity of an intertragic notch.

3. The sound pickup device according to claim 1, wherein the holding part holds the sound pickup part so that a microphone hole is oriented to outside of the ear canal.

4. The sound pickup device according to claim 1, wherein the holding part holds the sound pickup part so that a microphone hole is positioned on a farther side of an entrance of the ear canal.

5. The sound pickup device according to claim 1, wherein, in a case where the sound pickup device fits in an ear of the user, a relative position between a sound output hole of the sound output part and a sound pickup hole of the sound pickup part is kept constant.

6. The sound pickup device according to claim 1, wherein, in a case where the sound pickup device fits in an ear of the user, a sound output hole of the sound output part is positioned outside an ear cavity as compared with a sound pickup hole of the sound pickup part.

7. The sound pickup device according to claim 1, wherein the sound guide part has a hollow structure and is configured to capture a sound generated by the sound generation part from one end to propagate the sound to another end.

8. The sound pickup device according to claim 7, wherein the sound guide part is inserted in an intertragic notch in a vicinity of said another end.

9. The sound pickup device according to claim 1, wherein the sound guide part projects toward a direction of an entrance of the ear canal in a state where the ring body is inserted in a cavum concha of the user and has a sound output hole at a tip of the sound guide part.

10. The sound pickup device according to claim 1, further comprising a sound output hole provided on a front surface side of the housing of the sound output part.

11. The sound pickup device according to claim 1, further comprising an exhaust part on a rear surface of the housing of the sound output part.

12. The sound pickup device according to claim 11, wherein the exhaust part has an exhaust hole that extends from a rear surface side of the housing across an intertragic notch to outside of an auricle.

13. The sound pickup device according to claim 11, further comprising a signal line inserted through the exhaust part.

* * * * *